US006201939B1

(12) United States Patent
Yamamoto et al.

(10) Patent No.: US 6,201,939 B1
(45) Date of Patent: Mar. 13, 2001

(54) COLOR ELECTROPHOTOGRAPHIC APPARATUS HAVING A SPLIT TONER RESERVOIR

(75) Inventors: Hajime Yamamoto; Hiroshi Terada, both of Ikoma; Noboru Katakabe, Uji, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/478,460

(22) Filed: Jan. 6, 2000

Related U.S. Application Data

(62) Division of application No. 08/840,909, filed on Apr. 17, 1997, now abandoned.

(30) Foreign Application Priority Data

Apr. 23, 1996 (JP) ..... 8-101572
May 7, 1996 (JP) ..... 8-112455
Jun. 21, 1996 (JP) ..... 8-161311

(51) Int. Cl.[7] ..... G03G 15/01
(52) U.S. Cl. ..... 399/99; 399/227
(58) Field of Search ..... 399/98, 99, 112, 399/223, 226, 227; 347/115, 116

(56) References Cited

U.S. PATENT DOCUMENTS 4,707,108 * 11/1987 Ohno ..... 399/227
4,782,360 * 11/1988 Iwamoto et al. ..... 399/227
4,875,079 10/1989 Bisaiji et al. ..... 399/41
5,036,367 7/1991 Haneda et al. ..... 399/119
5,075,730 12/1991 Hoshi ..... 399/302
5,235,383 8/1993 Tada et al. ..... 399/112
5,351,115 * 9/1994 Yamamoto et al. ..... 399/226
5,587,783 12/1996 Nakamura ..... 399/301
5,612,771 3/1997 Yamamoto et al. ..... 399/301
5,787,328 * 7/1998 Sugihara et al. ..... 399/227 X
5,844,687 12/1998 Nagane et al. ..... 358/296

FOREIGN PATENT DOCUMENTS 61-095370 5/1986 (JP) .
04287070 10/1992 (JP) .
04318884 11/1992 (JP) .
6-82235 10/1994 (JP) .

* cited by examiner

*Primary Examiner*—Sandra Brase
(74) *Attorney, Agent, or Firm*—Akin, Gump, Strauss, Hauer & Feld, L.L.P.

(57) ABSTRACT

A color electrophotographic apparatus with a developing unit for one color larger than the developing units for the other colors, comprising a first optical path where the laser signals irradiated from a laser exposure device reach a mirror at the central portion of a columnar assembly of image forming units and a second optical path where the laser signals reflected by the mirror reach and expose the photoconductor of the image forming unit at the image forming position formed between two adjacent developing units is provided.

16 Claims, 25 Drawing Sheets

COLOR ELECTROPHOTOGRAPHIC APPARATUS HAVING A SPLIT TONER RESERVOIR

CROSS-REFERENCE TO RELATED APPLICATIONS

This application is a divisional patent application of pending U.S. patent application Ser. No. 08/840,909, filed Apr. 17, 1997 abandoned.

BACKGROUND OF THE INVENTION

The present invention relates to a color electrophotographic apparatus applicable to color printers, color copying machines, and color facsimiles.

In a color electrophotographic apparatus, a full color image is formed on an acceptor sheet such as a paper sheet by superimposing images of black, yellow, magenta and cyan toners. The color electrophotographic apparatus includes a continuous transfer type using a transfer belt in an image superimposing member for forming a full color image, and a transfer drum type using a transfer drum in the image superimposing member.

A conventional color electrophotographic apparatus disclosed in the Japanese Patent Application Laid Open Hei No. 7-36246 will be explained with reference to FIG. 25.

FIG. 25 is a side cross-sectional schematic view showing an entire configuration of a conventional color electrophotographic apparatus. The conventional color electrophotographic apparatus shown in FIG. 25 is the continuous transfer type using an intermediate transfer belt in the image superimposing member, a sheet up to an A-4 paper size (210×297 mm) can be printed. In the below-mentioned explanation, the same numeral will be applied to portions having the same function, and in the case that the toner color needs to be differentiated, letters designating the colors such as Y for yellow, M for magenta, C for cyan, and BK for black are added to the numerals.

In FIG. 25, an intermediate transfer belt unit 101 comprises an intermediate transfer belt 102, a first transfer roller 103, a second transfer roller 104, a cleaner 105, and a waste toner box 106. In the configuration, the full color image is formed by superimposing toner images of the four colors on the intermediate transfer belt 102.

As shown in FIG. 25, the conventional color electrophotographic apparatus comprises four sets of image forming units 107BK, 107C, 107M, 107Y of the same shape for black, cyan, magenta and yellow toners. The image forming units 107BK, 107C, 107M, 107Y are arranged in a substantially ring shape to form a substantially columnar assembly of image forming units 108. Each of the image forming units 107BK, 107C, 107M, 107Y is mounted in a predetermined position in the color electrophotographic apparatus. Thereby, the image forming units 107BK, 107C, 107M, 107Y are coupled to a driving system and an electric system of the conventional color electrophotographic apparatus by a coupling member (not shown), so that the image forming units 107BK, 107C, 107M, 107Y are integrated mechanically and electrically.

In the assembly of the image forming units 108, each of the image forming units 107BK, 107C, 107M, 107Y is supported by a supporting member (not shown) to be arranged in a ring-like shape. The assembly of the image forming units 108 is driven by a driving motor (not shown), so that the assembly of the image forming units 108 is rotated around a cylindrical shaft 109 arranged at the center of the assembly of the image forming units 108. The cylindrical shaft 109 is unrotatably fixed to an outer case of the conventional color electrophotographic apparatus.

When each of the toner images is formed, the image forming units 107BK, 107C, 107M, 107Y are rotated so that the respective photoconductors 118 are located at a image forming position 110 facing to the first transfer roller 103 for supporting the intermediate transfer belt 102. The image forming position 110 is an exposed position where laser signals 111 from a laser exposure device 112 expose the photoconductors 118.

As shown in FIG. 25, the laser exposure device 112 is arranged at a lower side of the conventional color electrophotographic apparatus. As shown by a dashed line in FIG. 25, the laser signals 111 irradiated from the laser exposure device 112 reach an opening formed on the shaft 109 through an entrance 113 of an optical path between the image forming unit 107M for magenta and the image forming unit 107C for cyan. The laser signals 111 are reflected by a mirror 114 fixed in the shaft 109. The laser signals 111 reflected by the mirror 114 enter the image forming unit 107BK located at the image forming position 110 through an exposure entrance 115 of the image forming unit 107BK.

The laser signals 111 having entered the image forming unit 107BK irradiate a side portion to be exposed of the photoconductor 118 through an optical path between a developing unit 116 and a cleaner portion 117. The laser signals 111 irradiating the photoconductor 118 are scanned in a direction of a generating line on the photoconductor 118, so that the photoconductor 118 is exposed and a black toner image is formed thereon.

The black toner image formed on the photoconductor 118 is transferred to the intermediate transfer belt 102 by the contact with the intermediate transfer belt 102.

Subsequently, the assembly of the image forming units 108 is rotated in the clockwise direction (shown by an arrow "Y") by 90 degrees, so that the image forming unit 107Y for yellow is arranged at the image forming position 110. Operations similar to that of the above-mentioned forming process for the black toner image are conducted, and thereby, a yellow toner image is superimposed on the black toner image transferred on the intermediate transfer belt 102.

Operations similar to that of the above-mentioned forming process for the black toner image or the yellow toner image are conducted in the image forming units 107M and 107C for magenta and cyan. Thereby, the full color image is formed on the intermediate transfer belt 102.

The full color image on the intermediate transfer belt 102 is transferred on a paper sheet supplied to the conventional color electrophotographic apparatus by a third transfer roller 119, and further the full color image transferred on the paper sheet is fixed by a fuser 120.

In the conventional color electrophotographic apparatus, four developing units 116 for each color are formed by the same size based on the premise that the black, cyan, magenta and yellow toners are consumed at the same rate.

However, in the inventor's experimental investigation, it is found that each color has a different consumption amount, and in particular, a black toner is consumed in a greater amount compared with the other colors. Therefore, in the conventional color electrophotographic apparatus, there occurs problems in that the black toner needs to be supplied more frequently than the other colors, requiring labor in the maintenance.

Furthermore, in the conventional continuous transfer type color electrophotographic apparatus, each of the four photoconductors 118 comes in contact with the intermediate transfer belt 102 and comes apart from the intermediate transfer belt 102 repeatedly. Therefore, there is a problem in that the intermediate transfer belt 102 stretched with a high tension is liable to generate vibration, resulting in disturbing the image. In particular, in the apparatus having a long distance between the roller shafts for stretching the intermediate transfer belt 102, an amplitude of the vibration becomes larger.

BRIEF SUMMARY OF THE INVENTION

The object of the present invention is to provide a color electrophotographic apparatus that can solve the aforementioned problems.

In order to achieve the above-mentioned object, a color electrophotographic apparatus comprises:

three or more image forming units for different colors, each of the three or more image forming units having one set of a developing unit, a charger, and a photoconductor, and at least one of the image forming units provided with a central angle around the central axis different from that of the other image forming units, a rotatable assembly of image forming units having the three or more image forming units arranged radially so as to form a substantially columnar shape, an image superimposing member for forming a full color image by accepting toner images formed on said photoconductor each of the image forming units at an image forming position, a laser exposure device for irradiating laser signals in accordance with the toner image to be printed, and an optical path forming means for forming a first optical path and a second optical path between adjacent two of the image forming units, the first optical path where the laser signals irradiated from the laser exposure device are reflected at a substantially central portion of the rotatable assembly of image forming units, and the second optical path where the reflected laser signals expose the photoconductor of the image forming unit at the image forming position.

In this color electrophotographic apparatus, the size of a developing unit can be changed depending upon consumption amount of the toner. Therefore, downsizing of the apparatus can be achieved with excellent productivity and economy.

The color electrophotographic apparatus of another aspect comprises:

three or more image forming units for different colors, and each of the three or more image forming units having one set of a developing unit, a charger, and a photoconductor, a rotatable assembly of image forming units having the three or more image forming units arranged radially so as to form a substantially columnar shape, a substantially columnar image superimposing member for forming a full color image by accepting toner images formed on the photoconductor each of the image forming units at an image forming position, and a dent portion arranged on a part of an outer periphery portion of the image superimposing member elongating parallel to a rotation axis of the image superimposing member.

This color electrophotographic apparatus comprises a dent portion formed on a part of the outer periphery of an image superimposing member, arranged elongating parallel to the rotation axis of the image superimposing member. Accordingly, generation of a flaw in a photoconductor caused by the contact with the image superimposing member can be prevented.

The color electrophotographic apparatus of another aspect comprises:

three or more image forming units for different colors, and each of the three or more image forming units having one set of a developing unit, a charger, and a photoconductor, a rotatable assembly of image forming units having the three or more image forming units arranged radially so as to form a substantially columnar shape, and a substantially columnar image superimposing member for forming a full color image by accepting toner images formed on the photoconductor each of the image forming units at an image forming position, the photoconductor is formed to have a columnar shape with a ratio represented by integers of the diameter of the photoconductor with respect to the diameter of the image superimposing member of one-fifth or smaller.

In this color electrophotographic apparatus, the photoconductor has a columnar shape having a diameter size of one-fifth of that of the image superimposing member or smaller with a ratio represented by integers. Accordingly, the color electrophotographic apparatus capable of providing a color print with a high image quality can be obtained without blurring of characters caused by toner scattering at the time of transfer.

The color electrophotographic apparatus of another aspect comprises:

three or more image forming units for different colors, and each of the three or more image forming units having one set of a developing unit, a charger, and a photoconductor, a rotatable assembly of image forming units having the three or more image forming units arranged radially so as to form a substantially columnar shape, and a substantially columnar image superimposing member for forming a full color image by accepting toner images formed on the photoconductor each of the image forming units at an image forming position, the developing unit for forming a non-magnetic toner thin film layer on a cylindrical toner carrier rotating at a peripheral speed substantially the same as that of the photoconductor to the opposite directions, an outer periphery length of the toner carrier represented by a fraction of one over an integer with respect to an outer periphery length of the photoconductor as well as represented by a fraction of one over an integer with respect to an outer periphery length of the image superimposing member.

In this color electrophotographic apparatus, the developing unit forms a thin film layer of a non-magnetic toner on a cylindrical toner carrier. The toner carrier and the organic photoconductor rotate at a peripheral speed substantially the same but to the opposite directions. Furthermore, the toner carrier is formed to have an outer periphery length represented by a fraction of one over an integer with respect to the outer periphery length of the photoconductor as well as represented by a fraction of one over an integer with respect to the outer periphery length of the image superimposing member. Accordingly, irregular rotation of the toner carrier or generation of a pressure flaw on an elastic blade can be prevented.

The color electrophotographic apparatus of another aspect comprises:

three or more image forming units for different colors, and each of the three or more image forming units having one set of a developing unit, a charger, and a photoconductor, a rotatable assembly of image forming units having the three or more image forming units arranged radially so as to form a substantially columnar shape, and a substantially columnar image superimposing member for forming a full color image by accepting toner images formed on the photoconductor each of the image forming units at an image forming position, the developing unit having a toner hopper accommodating a non-magnetic toner, an elastic blade for forming a toner thin film layer on a toner carrier, and a blade protecting member arranged at a position opposite to the direction to which gravity functions with respect to the elastic blade, for controlling toner supply amount from the toner hopper to the elastic blade.

In this color electrophotographic apparatus, the developing unit comprises a toner hopper accommodating a non-magnetic toner, an elastic blade for forming a toner thin film layer on a toner carrier, and a blade protecting member arranged at a position opposite to the direction to which gravity functions with respect to the elastic blade for controlling toner supply amount from the toner hopper to the elastic blade. Accordingly, deformation or generation of a pressure flaw of the elastic blade caused by toner pressure or problem in toner supply can be prevented.

The color electrophotographic apparatus of another aspect comprises:

three or more image forming units for different colors, and each of the three or more image forming units having one set of a developing unit, a charger, and a photoconductor, a rotatable assembly of image forming units having the three or more image forming units arranged radially so as to form a substantially columnar shape, a substantially columnar image superimposing member for forming a full color image by accepting toner images formed on the photoconductor each of the image forming units at an image forming position, and a spilt toner reservoir arranged to a lower direction with respect to the assembly of the image forming units.

This color electrophotographic apparatus of the present invention comprises a spilt toner reservoir to the lower direction with respect to the assembly of the image forming units. Since toner dropped from an image forming unit can be collected by the spilt toner reservoir, scattering of dropped toner in the apparatus can be prevented.

It will be recognized that some or all of the Figures are schematic representations for purposes of illustration and do not necessarily depict the actual relative sizes or locations of the elements shown.

DETAILED DESCRIPTION OF THE INVENTION

Hereafter, preferred embodiments of the present invention will be described with reference to the accompanying drawings.

<<First Embodiment>>

Figure 1:
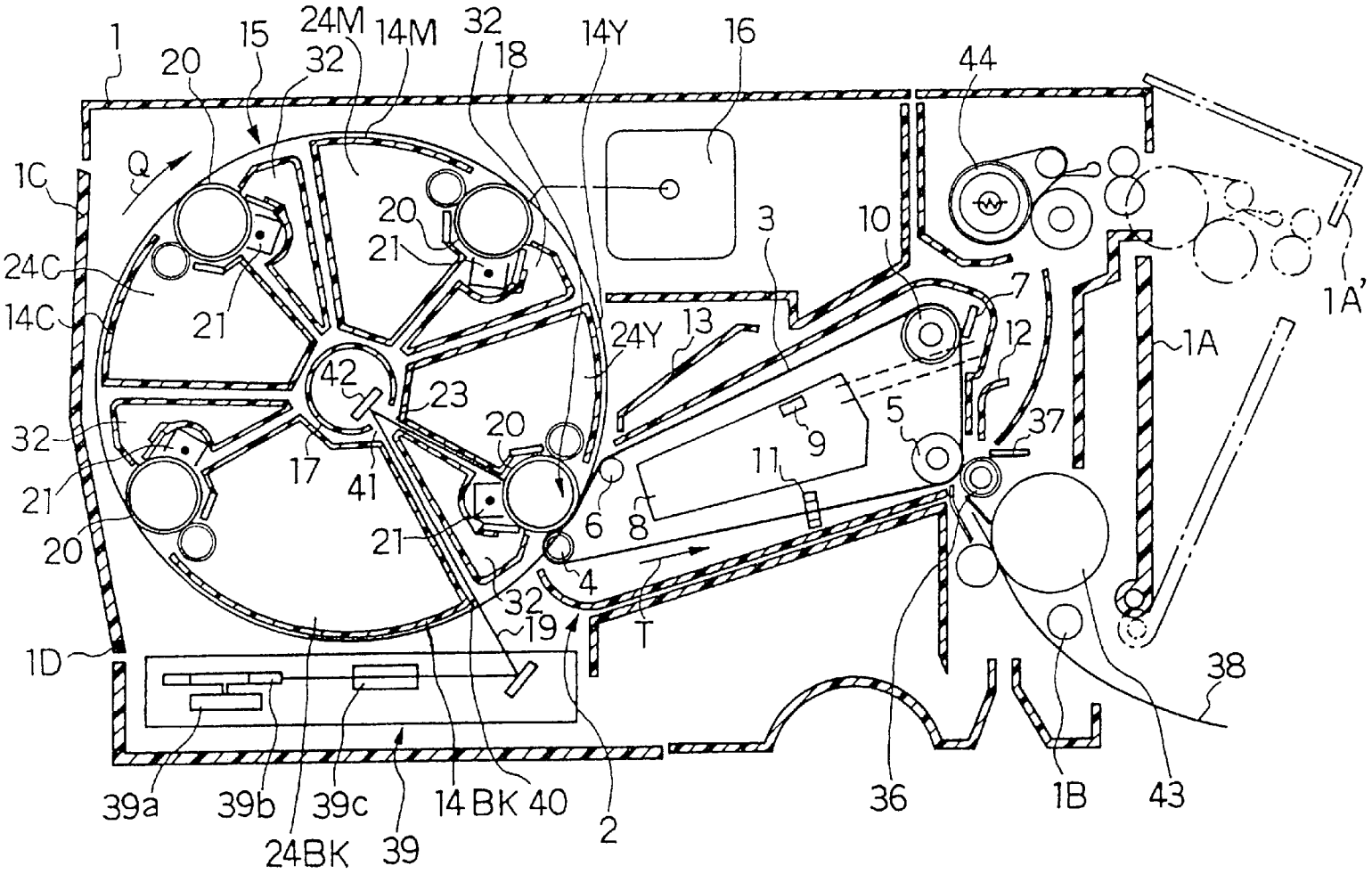
FIG. 1 is a side cross-sectional schematic view showing an entire configuration of a color electrophotographic apparatus in a first embodiment of the present invention.

FIG. 1 is a side cross-sectional schematic view showing an entire configuration of a color electrophotographic apparatus in a first embodiment of the present invention. In a color electrophotographic apparatus of this first embodiment, a removable intermediate transfer belt unit 2 is used as an image superimposing member. Further, the maximum printing size of the color electrophotographic apparatus is an A-4 paper size (210×297 mm). In the below-mentioned explanation, the same numerals will be applied to portions having the same function, and in the case that the toner color needs to be differentiated, letters designating colors such as Y for yellow, M for magenta, C for cyan, and BK for black are added to the numerals.

In FIG. 1, an outer case 1 of the color electrophotographic apparatus has a front plate 1A. This front plate 1A is configured so as to be opened by laying down or closed by raising up around a hinge shaft 1B arranged at a lower edge side of the outer case 1. The state where the front plate 1A is laid down for opening is shown by a dashed line 1A' in FIG. 1. Maintenance operations of the color electrophotographic apparatus such as attaching or detaching an intermediate transfer belt unit 2 and removal of a choked paper sheet are conducted in the state where the front plate 1A is laid down for widely opening the inside of the apparatus. The intermediate transfer belt unit 2 is designed movable in the direction perpendicular to the generating line, which is parallel to the rotation axis of an organic photoconductor 20 in an assembly of image forming units 15 later described, so that the intermediate transfer belt unit 2 is taken out from the front plate 1A.

The intermediate transfer belt unit 2 comprises an intermediate transfer belt 3, a first transfer roller 4, a second transfer roller 5, a tension roller 6, a belt cleaner 7, a waste toner box 8, a full waste toner detector 9, a back up roller 10, a position detector 11, a front cover 12 and a rear cover 13.

As shown in FIG. 1, a columnar assembly of image forming units 15 is arranged at a substantially central portion of the color electrophotographic apparatus. The assembly of the image forming units 15 comprises image forming units 14Y, 14M, 14C, 14BK for respective toner colors, that is, yellow, magenta, cyan and black. A cross-sectional view taken on a plane including the rotation axis of the columnar assembly of the image forming units 15 has four sets of substantially sectorial shapes for image forming units 14Y, 14M, 14C, 14BK. The image forming units 14Y, 14M, 14C, 14BK are separated from each other with gap portions having a narrow cross-section arranged radially from the central axis of the columnar shape. The image forming units 14Y, 14M, 14C, 14BK are formed at a predetermined position in the assembly of the image forming units 15 removably by opening a rear plate 1C located at the rear side of the outer case 1 around a hinge shaft 1D. Each of the image forming units 14Y, 14M, 14C, 14BK comprises an organic photoconductor 20 serving as a photoconductor, a corona charger 21 for charging the organic photoconductor 20, and a developing unit (any of 24Y, 24M, 24C and 24BK). Each of the image forming units 14BK, 14C, 14M, 14Y is mounted in a predetermined position in the color electrophotographic apparatus. Thereby, the image forming units 14BK, 14C, 14M, 14Y are coupled to a driving system and an electric system of the color electrophotographic apparatus by a coupling member (not shown), so that the image forming units 14BK, 14C, 14M, 14Y are integrated mechanically and electrically.

In the assembly of the image forming units 15, each of the image forming units 14BK, 14C, 14M, 14Y is supported by a supporting member (not shown) to be arranged in a ring-like shape. The assembly of image forming units 15 is driven by a moving motor 16 rotatably. The assembly of the image forming units 15 is designed so as to rotate around a cylindrical shaft 17 fixed to the outer case 1. That is, the image forming units 14Y, 14M, 14C, 14BK can rotate around the shaft 17 in the clockwise direction (shown by an arrow "Q"). Accordingly, the organic photoconductors 20 of the image forming units 14Y, 14M, 14C, 14BK can be successively positioned at a image forming position 18 facing to a transfer position between the first transfer roller 4 and the second transfer roller 6, which support the intermediate belt 3. When each of the organic photoconductors 20 is positioned at the image forming position 18, this organic photoconductor 20 can be irradiated with laser signals 19 from a laser exposure device 39.

As has been explained in the above, the four image forming units 14Y, 14M, 14C, 14BK are arranged radially from the central axis of the assembly of the image forming unit 15 to form a substantially columnar shape. The developing unit 24BK for black toner has an angle around the central axis different from that of the other developing units. The image forming units 14Y, 14M, 14C, 14BK have substantially sectorial shapes separated from each other with gap portions having a narrow cross-section.

Each of the image forming units 14Y, 14M, 14C, 14BK forms and transfers an image only at the image forming position 18. That is, each of the organic photoconductors 20 of the image forming units 14Y, 14M, 14C, 14BK is exposed by the laser signals 19 only at the exposing position and a toner image is transferred to the intermediate transfer belt 3 only at the transfer position.

The image forming units 14Y, 14M, 14C, 14BK will be described with reference to FIG. 2 and FIG. 3. Since the configuration and the operation of the image forming units 14Y, 14M, 14C, 14BK are substantially the same, explanation will be given only for the image forming unit 14BK for black toner. The image forming unit 14BK for black toner differs from the other image forming units 14Y, 14M, 14C only in the size of the developing unit 24, and thus all the image forming units are designed substantially the same.

Figure 2:
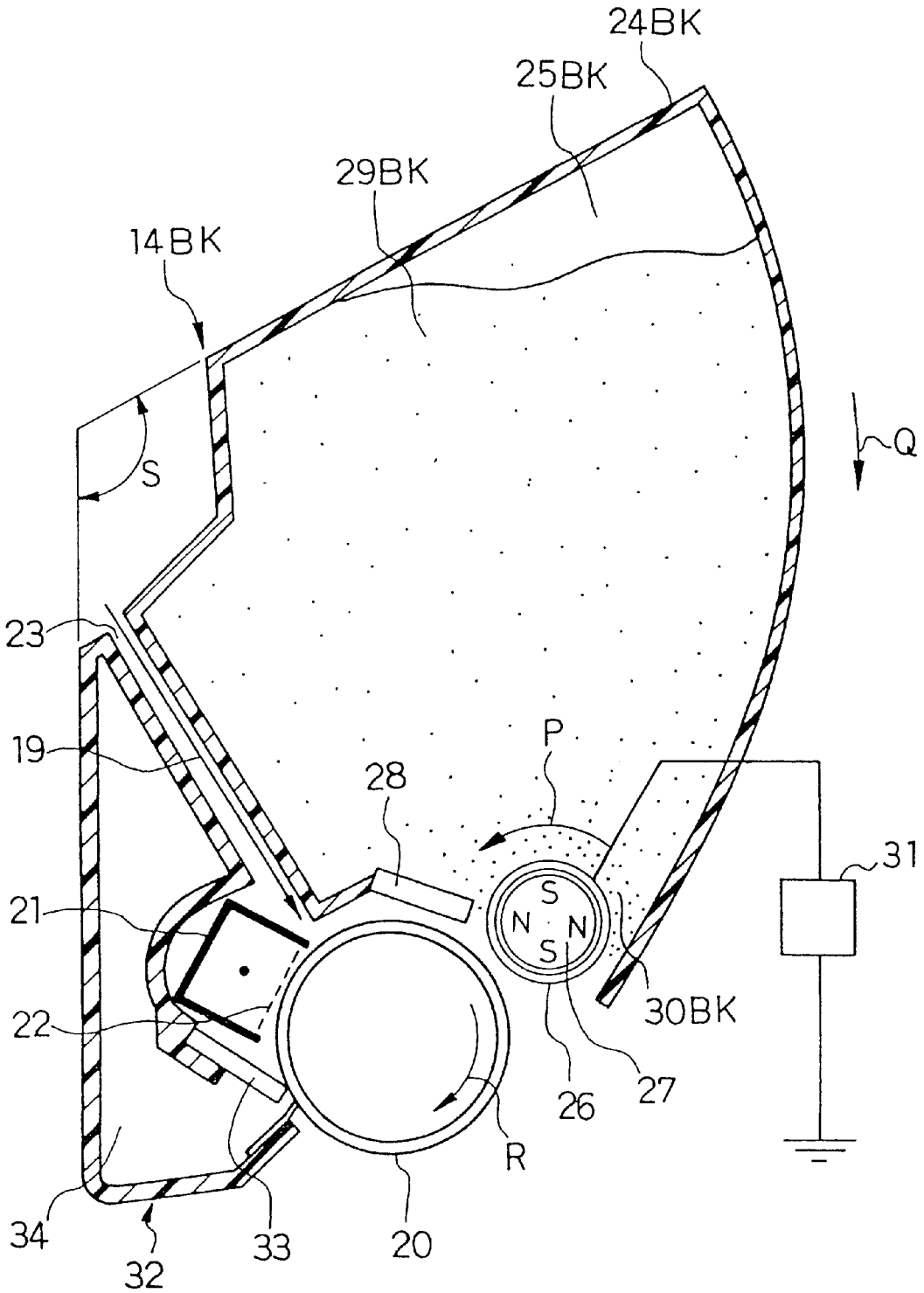
FIG. 2 is a cross-sectional enlarged view showing a configuration of a image forming unit for black in the first embodiment of the present invention.

FIG. 2 is a cross-sectional enlarged view showing a configuration of a image forming unit for black in the first embodiment of the present invention.

In FIG. 2, the organic photoconductor 20 is mainly made of a polycarbonate-containing binder resin and a phthalocyanine for a sensitive material. The corona charger 21 for minus-charging the organic photoconductor 20 is provided in the vicinity of the organic photoconductor 20. A grid 22 is provided in the corona charger 21 at a position facing to the organic photoconductor 20 for maintaining the charged potential of the organic photoconductor 20 at a constant level.

In FIG. 2, the laser signals 19 are irradiated from the laser exposure device 39 (shown in FIG. 1) and enter the image forming unit 14BK through an exposure entrance 23, which is the aperture of the image forming unit 14BK.

The image forming unit 14BK has a color developing unit 24BK for black. This color developing unit 24BK for black comprises a toner hopper 25BK, a developing roller 26, a magnet 27, and a blade 28.

The toner hopper 25BK for black accommodates a two-component developer 30BK which is a mixture comprising a ferrite carrier and a minus-charged black toner 29BK. Examples of the black toner 29BK include a polyester resin having a black pigment dispersed therein. Examples of the ferrite carrier include one having a particle size of 50 $\mu$m coated with a silicone resin on the surface thereof. The two-component developer 30BK is carried on the surface of the developing roller 26, which is the toner carrier, for developing the organic photoconductor 20. A voltage is applied to the developing roller 26 with a high voltage power supply 31.

After the toner image on the organic photoconductor 20 is transferred to the intermediate transfer belt 3, residual toner on the surface of the organic photoconductor 20 is cleaned with a cleaner portion 32. The cleaner portion 32 has a rubber cleaning blade 33 and a waste toner box 34 for storing waste toner.

The cylindrical organic photoconductor 20 has a diameter size of 30 mm and rotates with a peripheral speed of 100 mm/s to the direction shown by an arrow "R" in FIG. 2. The cylindrical developing roller 26 arranged facing to the organic photoconductor 20 has a diameter size of 16 mm and rotates with a peripheral speed of 140 mm/s to the direction shown by an arrow "P" in FIG. 2.

Figure 3:
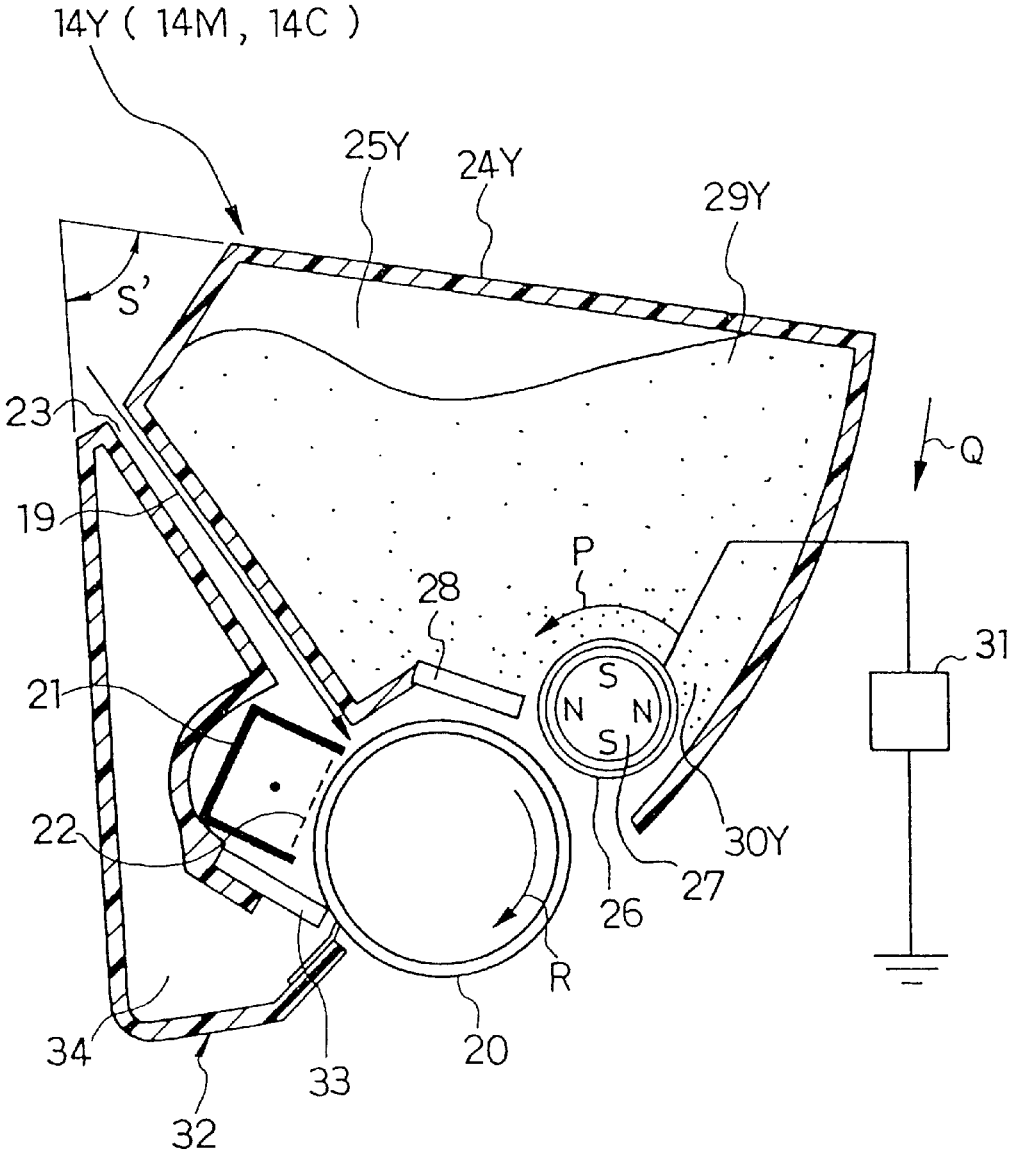
FIG. 3 is a cross-sectional enlarged view showing a configuration of a image forming unit for yellow in the first embodiment of the present invention.

FIG. 3 is a cross-sectional enlarged view showing a configuration of a image forming unit for yellow in the first embodiment of the present invention. The image forming units 14M and 14C for magenta and cyan are substantially the same as the image forming unit 14Y for yellow shown in FIG. 3.

In FIG. 3, the developing unit 24Y for yellow is different from the developing unit 24BK for black shown in FIG. 2 in size, however, substantially the same in terms of the other configurations.

As shown in FIG. 2, the image forming unit 14BK for black has a large substantially sectorial shape with a spreading angle S (a central angle) of 120 degrees. In the spreading angle 120 degrees, a central angle of the cleaner portion 32 accounts for about 30 degrees and a central angle of the developing unit 24BK for black accounts for about 90 degrees.

On the other hand, a spreading angle S' of the image forming unit 14Y is 80 degrees as shown in FIG. 3. In the spreading angle 80 degrees, a central degree of the cleaner portion 32 accounts for about 30 degrees and a central angle of the developing unit 24Y for yellow accounts for about 50 degrees.

As mentioned above, the central angles of the cleaner portions 32 are the same, however, the toner hopper 25BK for black has a capacity of 1.8 times as much as that of the other three toner hoppers 25Y, 25M, 25C. Since consumption amount of a black toner is larger than that of the other three colors generally, frequency of supplying a black toner can be drastically lowered to reduce the workload in maintaining the color electrophotographic apparatus by means of such large toner hopper 25BK for black. Furthermore, since the same constituent parts are used in many portions including the cleaner portion 32 and the organic photoconductor 20, the color electrophotographic apparatus of this first embodiment is excellent in terms of productivity and economy.

Color superimposing operation with the intermediate transfer belt unit 2 will be described in detail with reference to FIG. 1.

As mentioned above, the intermediate transfer belt unit 2 can be removed from the outer case 1. The intermediate transfer belt unit 2 is mounted at a predetermined position in the outer case 1 removably by laying down and opening the front plate 1A. When the intermediate transfer belt unit 2 is taken out to the outside from the outer case 1, the front cover 12 and the rear cover 13 of the intermediate belt unit 2 move so as not to expose the surface of the intermediate transfer belt 3 to the outside for protecting the intermediate transfer belt 3.

When the intermediate transfer belt unit 2 conducts the color superimposing operation at a predetermined position of the color electrophotographic apparatus, the front cover 12 and the rear cover 13 moves to the positions shown in FIG. 1, so that the intermediate transfer belt 3 is exposed.

The intermediate transfer belt 3 has an endless belt shape with a thickness of 100 μm. The intermediate transfer belt 3 has a semiconductive polycarbonate as the base material with a surface layer formed by coating a fluorine resin such as PFA and PTFE. An entire thickness of the intermediate transfer belt 3 is 100 to 500 μm.

The intermediate transfer belt 3 is laid on a first transfer roller 4, a second transfer roller 5, a tension roller 6, and a back up roller 10, and is movable in the direction shown by an arrow "T" in FIG. 1.

The intermediate transfer belt 3 is designed to have a peripheral length of 360 mm, which is equal to the length obtained by adding the longitudinal length (297 mm) of the A-4 paper size and a length (63 mm) slightly longer than half of the peripheral length of the organic photoconductor 20 (diameter 30 mm). The length of the intermediate transfer belt 3 between a position where the second transfer roller 5 and the third transfer roller 36 contact to each other and a position where the belt cleaner 7 and the back up roller 10 contact to each other is designed to be 55 mm, which is slightly shorter than the above-mentioned 63 mm length.

The moving speed of the intermediate transfer belt 3 is set to be faster by 1.5% than the image formation speed each of the image forming units 14Y, 14M, 14C, 14BK, that is, the peripheral speed 100 mm/s of the organic photoconductor 20 in order to prevent a partial transfer error in the toner image. By adjusting the moving speed in the above, the present inventors confirmed that the partial transfer error did not generate in plural experiments.

A discharge pin 37 arranged to be contact with a third transfer roller 36 prevents the toner image from distorting when the paper sheet 38 comes apart from the intermediate transfer belt 3. Because of the similar reason, the moving speed of the third transfer belt 3 is set to be slower by 1.5% than the moving speed of the intermediate transfer belt 3 in order to prevent a partial transfer error in the toner image.

The laser exposure device 39 arranged at a lower side of the outer case 1 comprises a semiconductor laser (not shown), a scanner motor 39*a*, a polygon mirror 39*b*, and a lens system 39*c*. From the laser exposure device 39, laser signals 19 are irradiated in accordance with image signals of image information. The irradiated laser signals 19 pass through an entrance 40 of an optical path formed between the developing unit 24BK of the image forming unit 14BK for black and the cleaner 32Y of the image forming unit 14Y for yellow. The laser signals 19 enter the shaft 17 from an aperture 41 formed on a part of the shaft 17 and are reflected by a mirror 42 fixed inside the shaft 17. The laser signal 19 reflected by the mirror 42 enter the image forming unit 14Y from the exposure entrance 23 of the image forming unit 14Y at the image forming position 18. The laser signals 19 pass through the path between the developing unit 24Y for yellow and the cleaner 32 in the image forming unit 14Y and irradiate the side portion to be exposed of the organic photoconductor 20. The laser signals 19 irradiating the portion to be exposed of the photoconductor 20 are scanned in the generating line direction of the photoconductor 20, so that an electrostatic latent image is formed on the organic photoconductor 20. The electrostatic latent image on the organic photoconductor 20 is converted to the toner image by the developing roller 26.

An optical path of the laser signals 19 is set between the two adjacent developing units. For example, as shown in FIG. 1, optical paths of the laser signals 19 comprise a first optical path where the laser signals 19 irradiated from the laser exposure device 39 reach the mirror 42 and a second optical path where the laser signals 19 reflected by the mirror 42 reach and expose the organic photoconductor 20 of the image forming unit 14Y at the image forming position 18. The first and second optical paths are designed to be between the developing unit 24BK for black and the developing unit 24Y for yellow adjacent to each other. Therefore, even though the developing unit 24BK for black is larger than the other developing units as mentioned above, exposure of the image forming unit (for example, for yellow) at the image forming position 18 will not be interrupted by the other image forming unit (for example, for black).

Furthermore, since the second optical path is formed at a gap between the walls of two adjacent image forming units, there is little unutilized space in the assembly of the image forming units 15.

Besides, since the mirror 42 is arranged at the central portion of the assembly of the image forming units 15, the mirror 42 can be consisted of only one fixed mirror. Accordingly, the color electrophotographic apparatus of this first embodiment provides a simple configuration allowing easy positioning.

As shown in FIG. 1, a feeding roller 43 is provided in the vicinity of the inner side of the front plate 1A for feeding a paper sheet 38 to a nip portion contacted and pressed with the intermediate transfer belt 3 and the third transfer roller 36. Further, a fuser 44 is provided at the right side upper portion of the color electrophotographic apparatus.

Full color image formation process in the color electrophotographic apparatus of this first embodiment will be explained. In the color electrophotographic apparatus shown in FIG. 1, the image forming unit 14Y for yellow is at the image forming position 18 in the initial state.

In the color electrophotographic apparatus of this first embodiment, a yellow image formation process is implemented first. The operation in the image formation process in the image forming unit 14Y will be described with reference to FIG. 3.

In FIG. 3, the corona charger 21 applies a voltage of −450 V to the grid 22, so that the organic photoconductor 20 is charged to −450 V. The laser signals 19 are irradiated to the organic photoconductor 20 for forming an electrostatic latent image. The exposed potential of the organic photoconductor 20 at this time is −50 V.

The organic photoconductor 20 is developed with the developing roller 26 carrying a two-component developer 30Y for yellow toner. In the developing operation, the developing roller 26 is applied with a DC voltage of +100 V with the high voltage power supply 31 at the time of facing to an uncharged area of the organic photoconductor 20. Further, the developing roller 26 is applied with a DC voltage of −250 V with the high voltage power supply 31 at the time of facing to the surface of a portion of the organic photoconductor 20 where an electrostatic latent image is written by charging to −450 V. Thereby, the yellow toner image with the positive and negative parts inverted is formed only on the image portion on the surface of the organic photoconductor 20.

As has been explained in the above, in the image formation process in the image forming unit 14Y, the moving speed of the intermediate transfer belt 3 at the time of the image formation with a yellow toner is set to be faster by 1.5% than the peripheral speed of the organic photoconductor 20 in order to prevent the partial transfer error of the yellow toner image. Accordingly, the yellow toner image is transferred onto the intermediate transfer belt 3 substantially simultaneously as the image formation. At that time, a DC voltage of +1.0 kV is applied to the first transfer roller 4 and the tension roller 6.

In the assembly of the image forming units 15 in FIG. 1, the image forming unit 14Y for yellow is at the image forming position 18 with the organic photoconductor 20 contacting with the intermediate transfer belt 3. Immediately after completing transfer of the yellow toner image, the first transfer roller 4 moves to the inner side. Thereby, the intermediate transfer belt 3 is moved and located at a position not contacting with the organic photoconductor 20 of the image forming unit 14Y.

The assembly of image forming units 15 is driven by the moving motor 16 to rotate by 80 degrees to the direction shown by the arrow "Q" in FIG. 1, so that the image forming unit 14M for magenta is located at the image forming position 18.

When the image forming unit 14M for magenta is located at the image forming position 18, the laser signals 19 corresponding to the magenta color are irradiated to the organic photoconductor 20 of the image forming unit 14M from the laser exposure device 39 in the process the same as that of the above-mentioned yellow toner image formation. Then, in the image forming unit 14M for magenta, the magenta toner image is formed and transferred. The intermediate transfer belt 3 is rotated by one turn before the magenta toner image is formed, and a timing of starting writing with laser signals 19 for the magenta toner image is controlled in accordance with signals from the position detector 11. That is, the intermediate transfer belt 3 is moved to be located at a position where the magenta toner image and the transferred yellow toner image are superimposed. Since the third transfer roller 36 is withdrawn at a position not contacting with the intermediate transfer belt 3 during the movement of the intermediate transfer belt 3 to the initial position, the toner image formed on the intermediate transfer belt 3 will be not disturbed.

Again the assembly of image forming units 15 is driven by the moving motor 16 to rotate by 80 degrees to the direction shown by the arrow "Q", so that the image forming unit 14C for cyan is located at the image forming position 18. As the image formation processes for yellow and magenta, the cyan toner image is formed on the intermediate transfer belt 3 with the image forming unit 14C for cyan.

Finally, the assembly of image forming units 15 is rotated by 80 degrees to the direction shown by the arrow "Q", so that the image forming unit 14BK for black is located at the image forming position 18. As the above-mentioned image formation processes, the black toner image is formed on the intermediate transfer belt 3.

Thus, the four color toner images are superimposed on the intermediate transfer belt 3 to form the full color image. After transfer of the black toner image, a voltage of +3 kV is applied to the third transfer roller 36. Thereby, the four color toner images are transferred onto the paper sheet 38 fed from the paper cassette at a time. The four color toner images transferred on the paper sheet 38 are fixed by the fuser 44. Then, the paper sheet 38 is discharged to the outside.

Thereafter, the assembly of image forming units 15 is rotated by 120 degrees to the direction shown by the arrow "Q" in FIG. 1, so that the image forming unit 14Y for yellow is located at the image forming position 18. That is, the color electrophotographic apparatus is in the initial state where a new full color image formation can be initiated.

As mentioned above, it is preferable to conduct the black image formation process at last in the full color image formation process. The reason why is that a predetermined time is needed for cleaning the intermediate transfer belt and for data transfer from the computer to the color electrophotographic apparatus after completing the full color image formation process. Therefore, in the case of continuously forming the full color image, a predetermined waiting time is necessary between the continuous image formation processes. On the other hand, in the color electrophotographic apparatus of this first embodiment, the spreading angle S' each of the image forming units 14Y, 14M, 14C for yellow, magenta, cyan is set to 80 degrees, and the spreading angle S of the image forming unit 14BK for black is set to 120 degrees. Therefore, the time required for replacing the image forming units after the black image formation process is longer than the time required for replacing the image forming units after the image formation processes for the other colors. Accordingly, by conducting the black image formation process at last, time reduction in the image formation processes can be easily achieved by efficiently implementing continuous image formation processes even in the case of forming the full color images continuously.

Although a two-component magnetic brush developing method is used in this first embodiment as a developing method in the image forming unit, other developing methods or charging methods such as an elastic rubber roller developing method, a jumping developing method, and an impression developing method can be used as well.

<<Second Embodiment>

Figure 4:
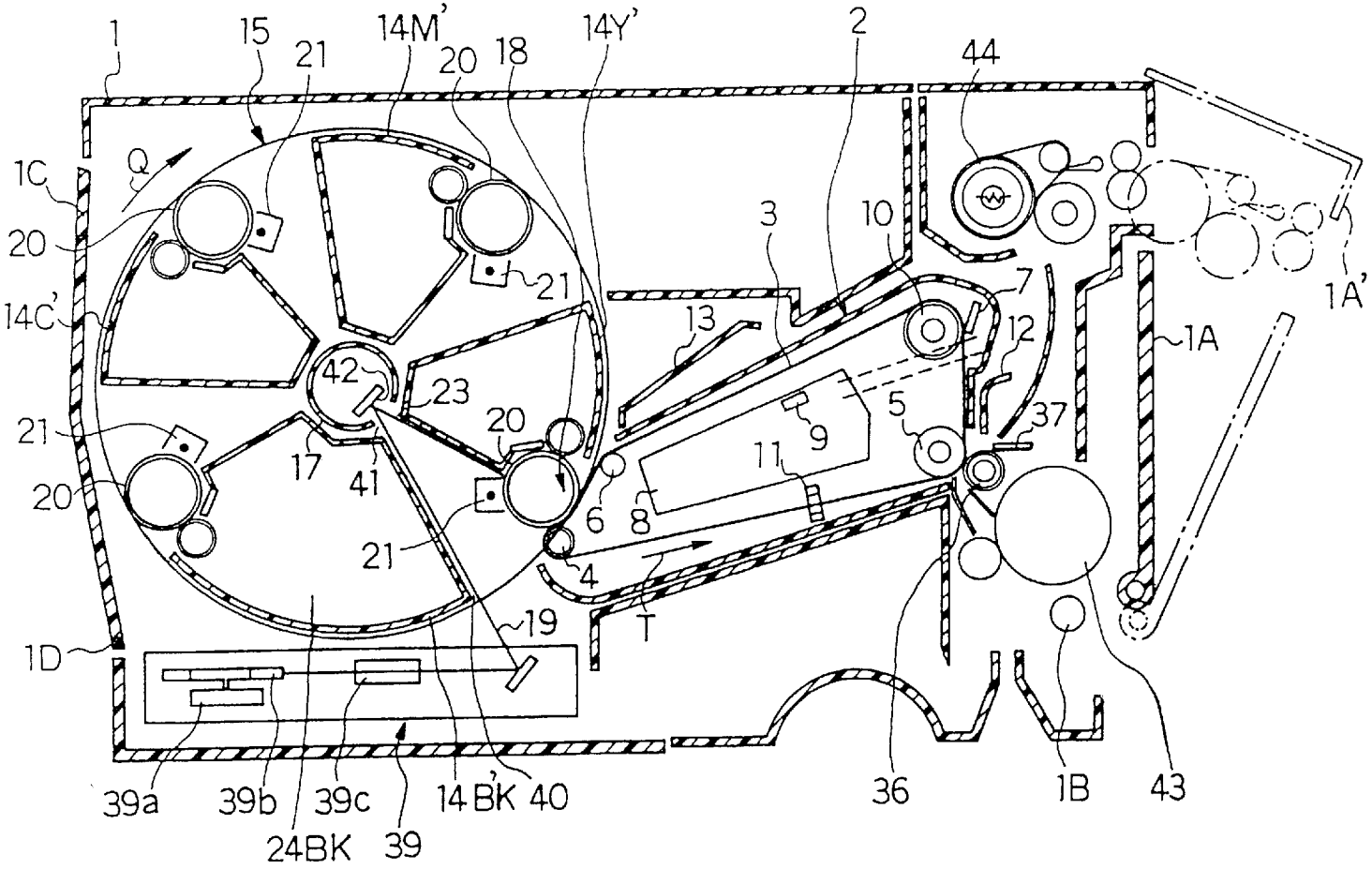
FIG. 4 is a side cross-sectional schematic view showing an entire configuration of a color electrophotographic apparatus in a second embodiment of the present invention.

FIG. 4 is a side cross-sectional schematic view showing an entire configuration of a color electrophotographic apparatus in a second embodiment of the present invention. The same numerals are applied to the portions having the same functions as those of the first embodiment, and further explanation will not be provided.

As shown in FIG. 4, a color electrophotographic apparatus of this second embodiment is a so-called cleaningless process type, which is not provided with the cleaner portion in each of the image forming units. The color electrophotographic apparatus of this second embodiment comprises the developing units having different storage capacity of the toner with a developing unit 14BK' for black larger than developing units 14Y', 14M', 14C' for the other colors.

The optical path of the laser signals 19 from the laser exposure device 39 to the image forming position 18 is adjusted and arranged so as to utilize the space between adjacent two image forming units. For example, as shown in FIG. 4, the optical path of the laser signals 19 is formed between the corona charger 21 of the image forming unit 14Y' for yellow at the image forming position 18 and the adjacent developing unit 24BK of the image forming unit 14BK' facing to the corona charger 21.

<<Third Embodiment>

Figure 5:
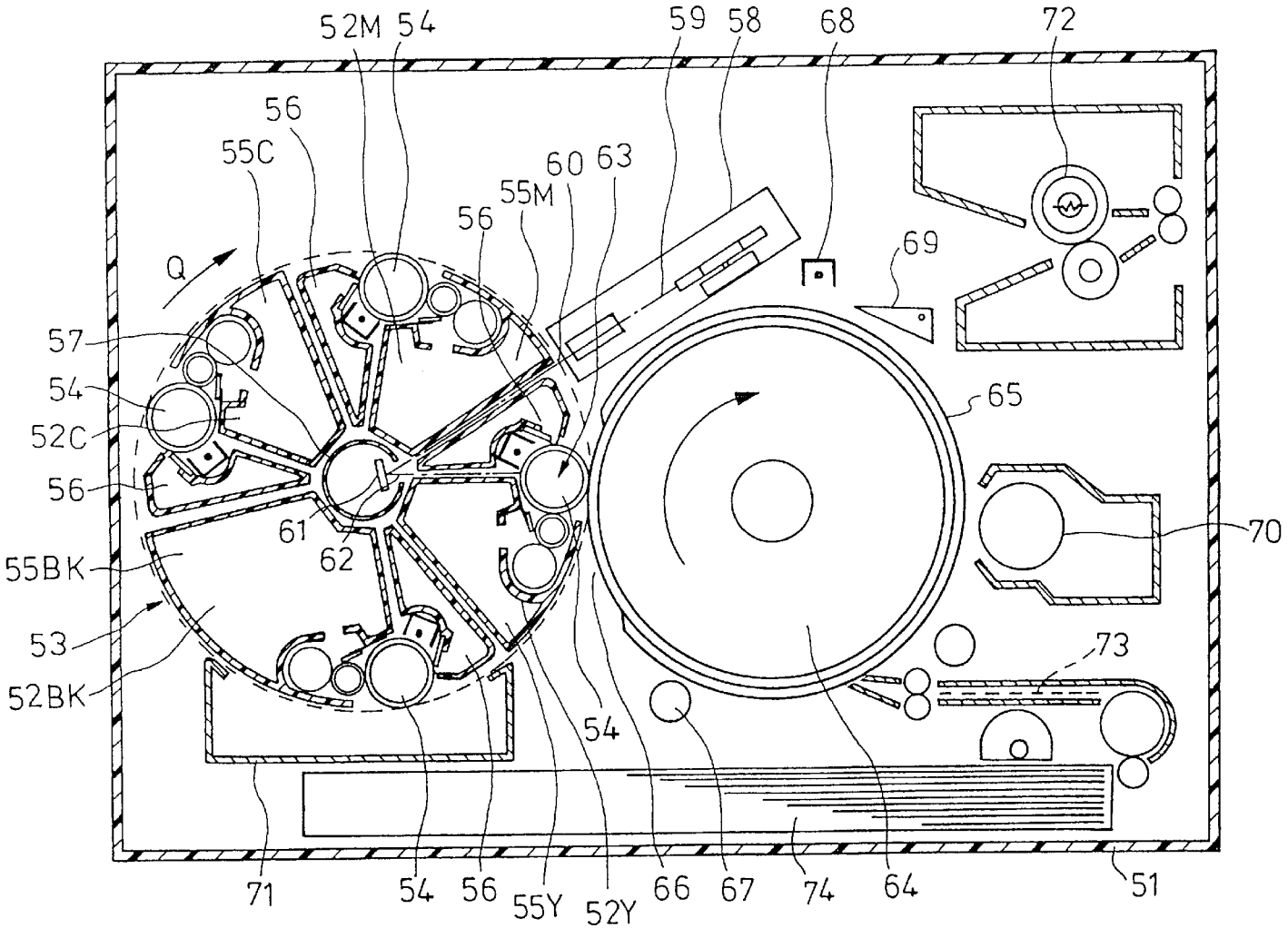
FIG. 5 is a side cross-sectional schematic view showing an entire configuration of a color electrophotographic apparatus in a third embodiment of the present invention.

FIG. 5 is a side cross-sectional schematic view showing an entire configuration of a color electrophotographic apparatus in a third embodiment of the present invention. A color electrophotographic apparatus of this third embodiment uses a transfer drum as the image superimposing member. That is, in the color electrophotographic apparatus, each of the toner images of black, yellow, magenta and cyan is successively transferred directly to the paper sheet wound on the transfer drum, so that the full color image is formed on the paper sheet (details will be described later).

As shown in FIG. 5, a columnar assembly of image forming units 53 is arranged inside an outer case 51 of the color electrophotographic apparatus. The assembly of the image forming units 53 comprises image forming units 52Y, 52M, 52C, 52BK for respective toner colors, that is, yellow, magenta, cyan and black. A cross-sectional view taken on a plane including the rotation axis of the columnar assembly of the image forming units 53 comprises four sets of substantially sectorial shapes for image forming units 52Y, 52M, 52C, 52BK. The image forming units 52Y, 52M, 52C, 52BK are separated from each other with gap portions having a narrow cross-section arranged radially from the central axis of the columnar shape. Each of the image forming units 52BK, 52C, 52M, 52Y is mounted in a predetermined position in the color electrophotographic apparatus. Thereby, the image forming units 52BK, 52C, 52M, 52Y are coupled to a driving system and an electric system of the color electrophotographic apparatus by a coupling member (not shown), so that the image forming units 52BK, 52C, 52M, 52Y are integrated mechanically and electrically.

In the assembly of the image forming units 53, each of the image forming units 52BK, 52C, 52M, 52Y is supported by a supporting member (not shown) to be arranged in a ring-like shape. The assembly of image forming units 53 is driven by a moving motor (not shown) rotatably. The assembly of the image forming units 53 is designed so as to rotate around a cylindrical shaft 57 fixed to the outer case 1 in the clockwise direction shown by an arrow "Q" of FIG. 5. Thereby, the respective photoconductors 54 of the image forming units 52Y, 52M, 52C, 52BK can be successively positioned at a image forming position 63 facing to a transfer drum 64. When each of the organic photoconductor 54 is positioned at the image forming position 63, the organic photoconductor 54 can be irradiated with laser signals 59 from a laser exposure device 58. The developing unit 55BK for black is designed to be larger than the developing units 55Y, 55C, 55M for the other colors as in the above-mentioned first and second embodiments. That is, the developing unit 55BK for black has an angle around the central axis different from that of the developing units for the other colors.

A spilt toner reservoir 71 is provided to the lower direction, that is, the direction to which the gravity functions, with respect to the assembly of the image forming units 53. Thereby, scattering of toner dropped from each of the image forming units 52Y, 52M, 52C, 52BK in the outer case 51 can be prevented.

The laser exposure device 58 arranged at an upper side of the outer case 51, the laser signals 59 from the laser exposure device 58 are irradiated in accordance with image signals of image information. As shown in FIG. 5, the laser signals 59 pass through an entrance 60 of an optical path formed between the developing unit 55M of the image forming unit 52M for magenta and the cleaner portion 56 of the image forming unit 52Y for yellow. The laser signals 59 enter the shaft 57 from an aperture 62 formed on a part of the shaft 57 and are reflected by a mirror 61 fixed inside the shaft 57. The laser signals 59 reflected by the mirror 61 enter the image forming unit 52Y for yellow from an exposure entrance 62 of the image forming unit 52Y at the image forming position 63. The laser signals 59 pass through a path between the developing unit 55Y and the cleaner portion 56 in the image forming unit 52Y and irradiate the side portion to be exposed of the organic photoconductor 54. The laser signals 59 irradiating the portion to be exposed of the organic photoconductor 54 are scanned in the generating line direction of the organic photoconductor 54, so that the electrostatic latent image is formed on the organic photoconductor 54. The yellow toner image formed on the organic photoconductor 54 is transferred onto a paper sheet 73 on the transfer drum 64 at the image forming position 63.

As the above-mentioned first and second embodiments, in the color electrophotographic apparatus of this first embodiment, each of the image forming units 52Y, 52M, 52C, 52BK forms and transfers the toner image only at the image forming position 63. That is, the organic photoconductor 54 each of the image forming units 52Y, 52M, 52C, 52BK is exposed by the laser signals 59 only at the exposing position. Furthermore, the toner image is transferred directly onto a paper sheet 73 wound on a surface elastic layer 65 formed on the substantially columnar transfer drum 64 only at the transfer position.

An optical path of the laser signals 59 is set between the two adjacent developing units as in the first and second embodiments. For example, as shown in FIG. 5, optical paths of the laser signals 59 comprise a first optical path where the laser signals 59 irradiated from the laser exposure device 58 reach the mirror 61 and a second optical path where the laser signals 59 reflected by the mirror 61 reach and expose the organic photoconductor 54 of the image forming unit 52Y at the image forming position 63. The first and second optical paths are designed to be between the developing unit 55BK for black and the developing unit 55Y for yellow adjacent to each other. Therefore, as has been explained in the above, even though the developing unit 55BK for black is larger than the other developing units, exposure of the image forming unit (for example, for yellow) at the image forming position 63 will not be interrupted by the other image forming unit (for example, for black).

Furthermore, since the second optical path is formed at a gap between the walls of two adjacent image forming units, there is little unutilized space in the assembly of the image forming units 53.

Besides, since the mirror 61 is arranged at the central portion of the assembly of the image forming units 53, the mirror 61 can be consisted of only one fixed mirror. Accordingly, the color electrophotographic apparatus of this third embodiment provide a simple configuration allowing easy positioning.

As shown in FIG. 5, a paper pick-up roller 67 for winding the paper sheet 73 from the paper cassette 74 around the transfer drum 64, a paper detaching charger 68 for detaching the paper sheet 73 with the full color image formed thereon from the transfer drum 64, a detach nail 69 and a cleaner 70 for cleaning the surface of the transfer drum 64 are provided in the vicinity of the transfer drum 64. Furthermore, a fuser 72 is provided at an upper portion of the inside of the outer case 51. The full color image formed on the paper sheet 73 is fixed by the fuser 72.

The image forming units 52BK, 52Y, 52C, 52M will be described with reference to FIG. 6A and FIG. 6B. Since the configuration and the operation of the image forming units 52Y, 52M, 52C, 52BK are substantially the same, explanation will be given only for the image forming unit 52BK for black and explanations of the image forming units 52Y, 52M, 52C are omitted.

Figure 6A:
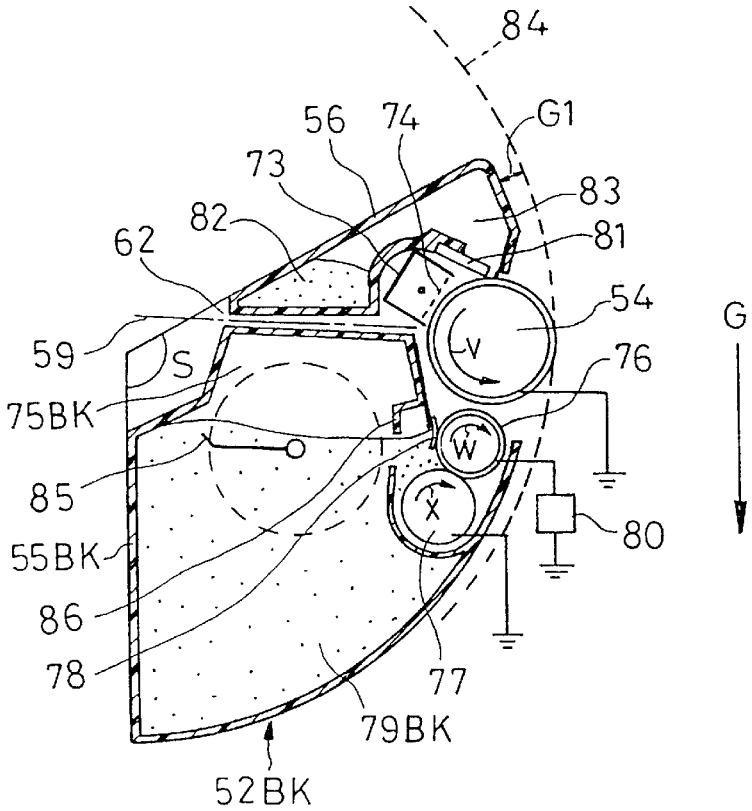
FIG. 6A is a cross-sectional enlarged view showing a configuration of a image forming unit for black in the third embodiment of the present invention.

FIG. 6A is a cross-sectional enlarged view showing a configuration of a image forming unit for black in the third embodiment of the present invention. In FIG. 6A, the image forming unit 52BK is in the state where the organic photoconductor 54 of the image forming unit 52BK is located at the image forming position 63. Further, an arrow "G" designates the direction to which the gravity functions.

In FIG. 6A, the image forming unit 52BK comprises the organic photoconductor 54, the developing unit 55BK for black, and the cleaner portion 56. The laser signals 59 irradiated from the laser exposure device 58 (FIG. 5) enter the image forming unit 52BK for black through the exposure entrance 62, which is the aperture of the image forming unit 52BK for black.

The organic photoconductor 54 is mainly made of the polycarbonate-containing binder resin and the phthalocyanine for the sensitive material. A corona charger 73 for minus-charging the organic photoconductor 54 is provided in the vicinity of the organic photoconductor 54. A grid 74 is provided in the corona charger 73 at a position facing to the organic photoconductor 54 for maintaining the charged potential of the organic photoconductor 54 at a constant level.

The developing unit 55BK for black comprises a so-called jumping developing unit, that is, a mono-component developing unit for flying a black toner 79BK. Specifically, the developing unit 55BK comprises a toner hopper 75BK for storing the black toner 79BK, a developing roller 76 for carrying the black toner 79BK, and a supply roller 77 for supplying the black toner 79BK to the developing roller 76. Furthermore, the developing unit 55BK has an elastic blade 78 formed with a urethane rubber, an agitator 85 for supplying the black toner 79BK from the toner hopper 75BK to the supply roller 77, and a blade protecting member 86 arranged between the elastic blade 78 and the agitator 85 for protecting the elastic blade 78.

The toner hopper 75BK for black accommodates a non-magnetic mono-component toner such as a black toner 79BK comprising a polyester resin with a black pigment dispersed therein. The black toner 79BK, which is minus-charged, is rubbed and charged with the supply roller 77. Furthermore, the black toner 79BK is formed as a thin film layer of about 30 $\mu$m by the elastic blade 78 on the surface of the developing roller 76 to be carried thereon. The black toner 79BK flies over a predetermined gap (such as 200 $\mu$m) between the developing roller 76 and the organic photoconductor 54 by the alternating electrical field from the developing roller 76 for developing the organic photoconductor 54. The above-mentioned alternating electrical field is generated by applying a predetermined developing bias voltage to the developing roller 76.

After the transfer of the toner image on the organic photoconductor 54 onto the paper sheet 73 (FIG. 5), residual toner on the surface of the organic photoconductor 54 is cleaned by the cleaner portion 56. The cleaner portion 56 comprises a rubber cleaning blade 81 and a waste toner box 83 for storing waste toner 82.

The cylindrical organic photoconductor 54 has a diameter size of 24 mm and rotates with a peripheral speed of 100 mm/s in the direction shown by an arrow "V". The cylindrical developing roller 76 arranged facing to the organic photoconductor 54 has a diameter size of 12 mm and rotates with a peripheral speed of 100 mm/s in the direction shown by an arrow "W". The supply roller 77 arranged in contact with the outer periphery surface of the developing roller 76 has a diameter of 13 mm and rotates with a peripheral speed of 60 mm/s in the direction shown by an arrow "X".

The locus of the outermost periphery portion of the organic photoconductor 54 is shown with a broken line 84 in FIG. 6A. The locus is equal to the outermost periphery circle formed when the assembly of the image forming units 53 (FIG. 5) rotates. A gap "Gl" (e.g. 5 mm) is provided between the dashed line 84 and the outermost periphery portion of the cleaner portion 56.

Figure 6B:
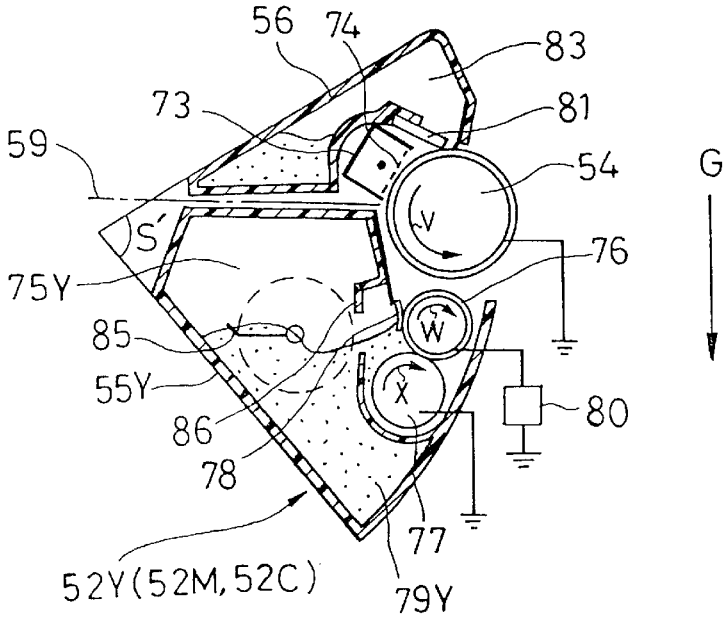
FIG. 6B is a cross-sectional enlarged view showing a configuration of a image forming unit for yellow in the third embodiment of the present invention.

FIG. 6B is a cross-sectional enlarged view showing a configuration of a image forming unit for yellow in the third embodiment of the present invention. In FIG. 6B, the image forming unit 52Y is in the state where the organic photoconductor 54 of the image forming unit 52Y is located at the image forming position 63. Further, an arrow "G" designates the direction to which the gravity functions. The image forming units 52M and 52C for magenta and cyan are substantially the same as the image forming unit 52Y for yellow shown in FIG. 6B.

In FIG. 6B, the developing unit 55Y for yellow is different from the developing unit 55BK for black shown in FIG. 6A in size, however, substantially the same in terms of the other configurations.

As shown in FIG. 6A, the image forming unit 52BK for black has a large substantially sectorial shape with a spreading angle S of 120 degrees. In the spreading angle 120 degrees, a central angle of the cleaner portion 56 accounts for about 30 degrees and a central angle of the developing unit 55BK for black accounts for about 90 degrees.

On the other hand, a spreading angle S' of the image forming unit 52Y is 80 degrees as shown in FIG. 6B. In the spreading angle 80 degrees, a central degree of the cleaner portion 56 accounts for about 30 degrees and a central angle of the developing unit 55Y for yellow accounts for about 50 degrees.

As in the above-mentioned first and second embodiments, the central angles of the cleaner portions 56 are the same, however, the toner hopper 75BK for black has a capacity of 1.8 times as much as that of the other three toner hoppers 75Y, 75M, 75C.

A transfer drum 64 will be concretely described with reference to FIG. 7A and FIG. 7B.

Figure 7A:
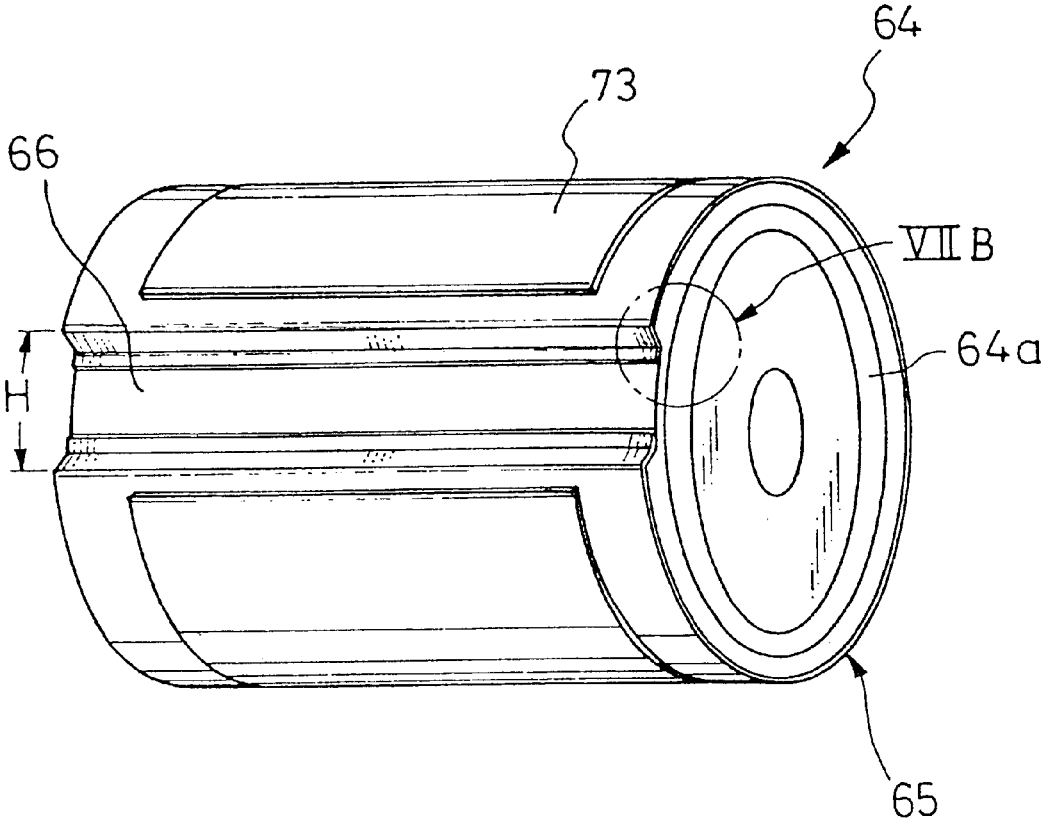
FIG. 7A is a perspective view showing a configuration of a transfer drum of this third embodiment of the present invention.

FIG. 7A is a perspective view showing a configuration of a transfer drum of this third embodiment of the present invention. FIG. 7B is an enlarged view showing a portion surrounded with a dashed line VIIB in FIG. 7A.

Figure 7B:
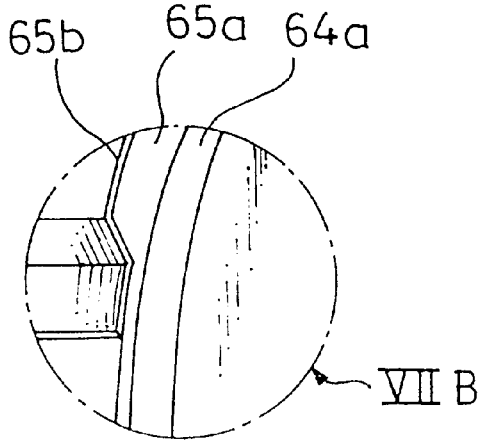
FIG. 7B is an enlarged view showing a portion surrounded with a dashed line VIIB in FIG. 7A.

In FIGS. 7A and 7B, the transfer drum 64 comprises a cylindrical drum main body 64*a* to which a predetermined transfer bias voltage is applied and a surface elastic layer 65 formed on the drum main body 64*a*. The drum main body 64*a* comprises a material such as aluminum with a diameter of, for example, 139 mm. The =surface elastic layer 65 comprises a conductive elastic foam layer 65*a* of a material such as polyurethane formed on the drum main body 64*a*, and a polyvinylidene fluoride film 65*b* formed on the conductive elastic foam layer 65*a*, providing the outer periphery surface of the transfer drum 64. Thickness of the surface elastic layer 65 is 5 mm, and the maximum diameter of the transfer drum 64 is 144 mm (=139 mm+5 mm). When the organic photoconductor 54 (FIG. 5) is located at the image forming position 63 (FIG. 5), the surface elastic layer 65 is pressed by the organic photoconductor 54 and thus it is compressed by about 2 mm to the direction of the central portion of the transfer drum 64. Thicknesses of the conductive elastic foam layer 65*a* and the polyvinylidene fluoride film 65*b* is about 5 mm and 60 $\mu$m, respectively.

The transfer drum 64 comprises a dent portion 66 on the surface elastic layer 65 formed on the outer periphery thereof, arranged elongating parallel to the rotation axis. The length of the dent portion 66 in the rotation axis direction is designed to be at least longer than the length of the organic photoconductor 54 in the rotation axis direction. Furthermore, the dent portion 66 has a predetermined depth from the outer periphery surface of the surface elastic layer 65, for example, of 4 mm. The outer periphery length of the dent portion 66 (shown by "H" in FIG. 7A, length 100 mm) is designed to be at least longer than the distance between the position where the organic photoconductor 54 comes in contact with the outer periphery portion of the transfer drum 64 and the position where the organic photoconductor 54 is located at the image forming position 63 (details will be explained later). Therefore, at the time the assembly of the image forming units 53 (FIG. 5) rotates, collision of the organic photoconductor 54 and the transfer drum 64 can be avoided. Accordingly, generation of flaw on the organic photoconductor 54 can be prevented.

The full color image formation process with the color electrophotographic apparatus of this third embodiment will be described. The color electrophotographic apparatus in FIG. 5 illustrates the initial state where the image forming unit 52Y for yellow is located at the image forming position 63. In the below-mentioned explanation, the paper sheet 73 is preliminarily fed from the paper cassette 74 and wound on the transfer drum 64 with the paper pick-up roller 67.

In the color electrophotographic apparatus of this third embodiment, as in the first and second embodiments, the yellow image formation process is implemented first. The operation in the image formation process in the image forming unit 52Y will be described with reference to FIG. 6B.

In FIG. 6B, the corona charger 73 applies the voltage of −450 V to the grid 74 for charging the organic photoconductor 54 to −450 V. The laser signals 59 are irradiated to the organic photoconductor 54 for forming the electrostatic latent image on the surface thereof. The exposed potential of the organic photoconductor 54 at the this time is −50 V.

The organic photoconductor 54 is developed with the developing roller 76 carrying a yellow toner 79Y, which is the non-magnetic mono-component toner. In the developing operation, at the time the developing roller 76 faces to a surface portion where the electrostatic latent image is written by charging to −450 V of the organic photoconductor 54, a developing bias voltage, for example, of 750 V0-P (peak to peak 1.5 kV) prepared by superimposing a DC voltage of −300 V is applied by the high voltage power supply 80. Accordingly, the yellow toner image with the positive and negative parts inverted is formed only on the image portion on the surface of the organic photoconductor 54. Then, the above-mentioned toner image is transferred onto the paper sheet 73 by pressing the paper sheet 73 wound on the transfer drum 64 and the surface elastic layer 65 with the organic photoconductor 54.

The assembly of image forming units 53 is driven by the moving motor (not shown) to rotate by 80 degrees to the direction shown by the arrow "Q" in FIG. 5, so that the image forming unit 52M for magenta is located at the image forming position 63.

Function of the dent portion 66 formed on the transfer drum 64 will be described with reference to FIG. 8A and FIG. 8B.

Figure 8A:
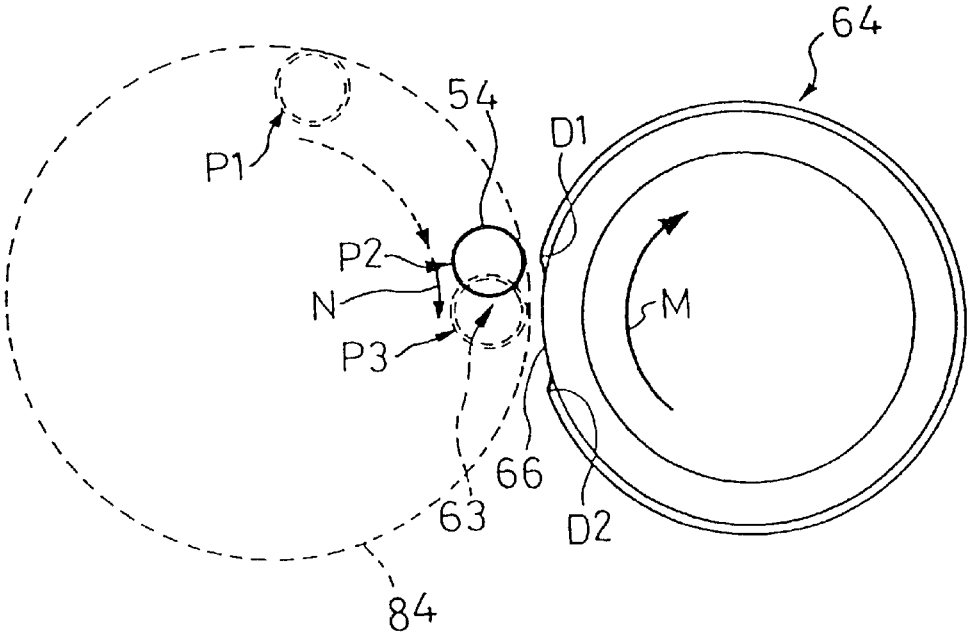
FIG. 8A is an explanatory view showing a positional relation between the organic photoconductor 54 and the dent portion 66 in the state before the image forming unit is located at the image forming position.

FIG. 8A is an explanatory view showing a positional relation between the organic photoconductor 54 and the dent portion 66 in the state before the image forming unit is located at the image forming position. FIG. 8B an explanatory view showing a positional relation between the organic photoconductor 54 and the dent portion 66 in the state after the image forming unit is located at the image forming position.

In FIG. 8A, the organic photoconductor 54 of the image forming unit 52M for magenta (FIG. 5) is located at the position P1 in FIG. 8A when the yellow image formation process is completed. Thereafter, by rotating the image forming unit 52M for magenta, the surface of the organic photoconductor 54 comes in contact with a portion Dl in FIG. 8A, which is the outer periphery portion of the transfer drum 64 as well as one end portion of the dent portion 66, at a portion P2 in FIG. 8A. However, since the organic photoconductor 54 and the transfer drum 64 rotate to the directions shown by arrows "N" and "M" in FIG. 8A, respectively, the organic photoconductor 54 faces to the dent portion 66 so as not to contact with the transfer drum 64. Accordingly, at the time the assembly of the image forming units 53 (FIG. 5) rotates, damage on the organic photoconductor 54 caused by the collision with the transfer drum 64 can be prevented.

Figure 8B:
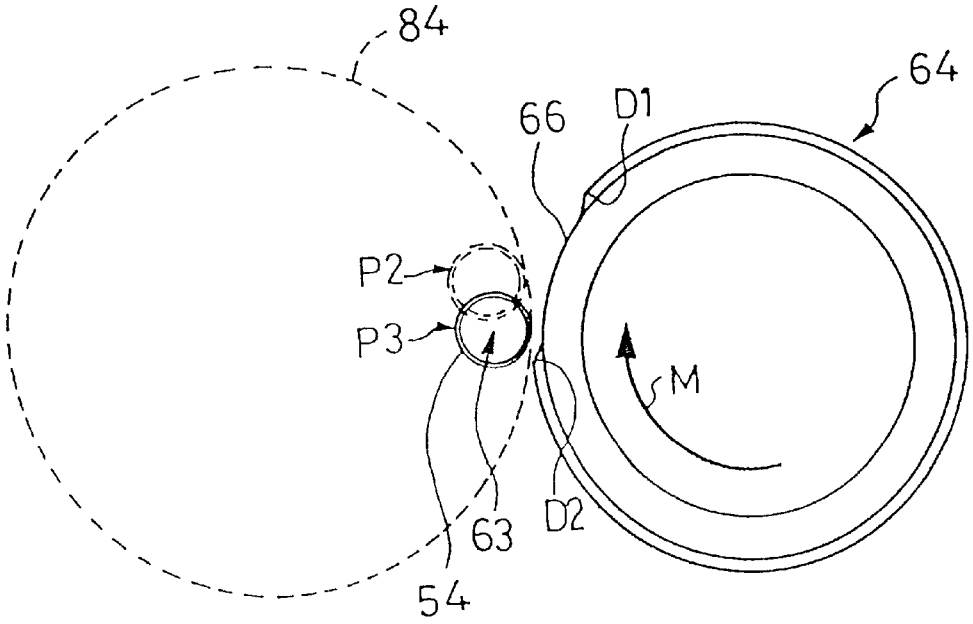
FIG. 8B an explanatory view showing a positional relation between the organic photoconductor 54 and the dent portion 66 in the state after the image forming unit is located at the image forming position.

When the image forming unit 52M is further rotated and reaches at the image forming position 63, the organic photoconductor 54 is located at a position P3 shown in FIG. 8B. In order to start the magenta image formation at the position P3, the organic photoconductor 54 and the transfer drum 64 need to contact to each other. Therefore, when the organic photoconductor 54 reaches the image forming position 63, the other end portion D2 of the dent portion 66 comes in contact with the organic photoconductor 54.

Thus, in the color electrophotographic apparatus of this third embodiment, the dent portion 66 is provided in a part of the transfer drum 64. Further, the outer periphery length of the dent portion 66 is designed to be at least longer than the distance between the position where the organic photoconductor 54 comes in contact with the outer periphery portion of the transfer drum 64 and the position where the organic photoconductor 54 is located at the image forming position 63. Therefore, when the assembly of the image forming units 53 rotates, the collision of the organic photoconductor 54 and the transfer drum 64 can be avoided. Accordingly, generation of flaw on the organic photoconductor 54 can be prevented.

When the image forming unit 52M for magenta is located at the image forming position 63 for starting the magenta image formation process, the organic photoconductor 54 for magenta starts rotation from the stationary state. About 0.3 second is needed until the rotation speed of the organic photoconductor 54 reaches at a constant rotation speed from the stationary state, which is the same as the rotation speed of the transfer drum 64. Therefore, if the organic photoconductor 54 and the transfer drum 64 contact to each other during the 0.3 second time, there will be a peripheral speed difference between the surface of the transfer drum 64 rotating at a constant rate and the surface of the organic photoconductor 54 rotating at an accelerating rate. In that case, the surface of the organic photoconductor 54 and the surface of the transfer drum 64 rub to each other. Thereby, the outer periphery length of the dent portion 66 is further defined in the color electrophotographic apparatus of this third embodiment.

Figure 9A:
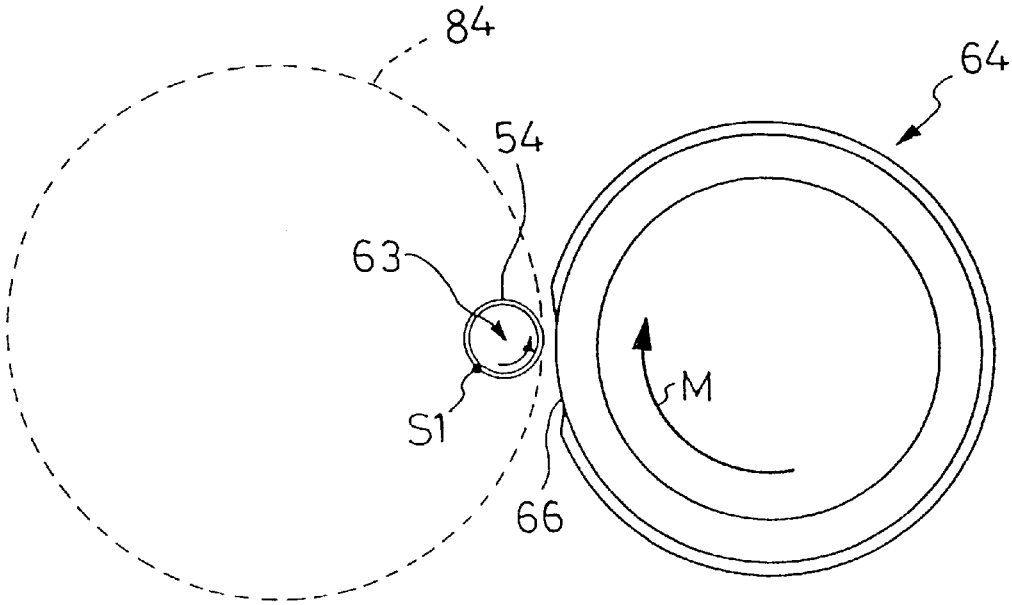
FIG. 9A is an explanatory view showing a positional relation between the organic photoconductor 54 and the dent portion 66 in the state before the organic photoconductor 54 reaches at a constant rotation speed.
Figure 9B:
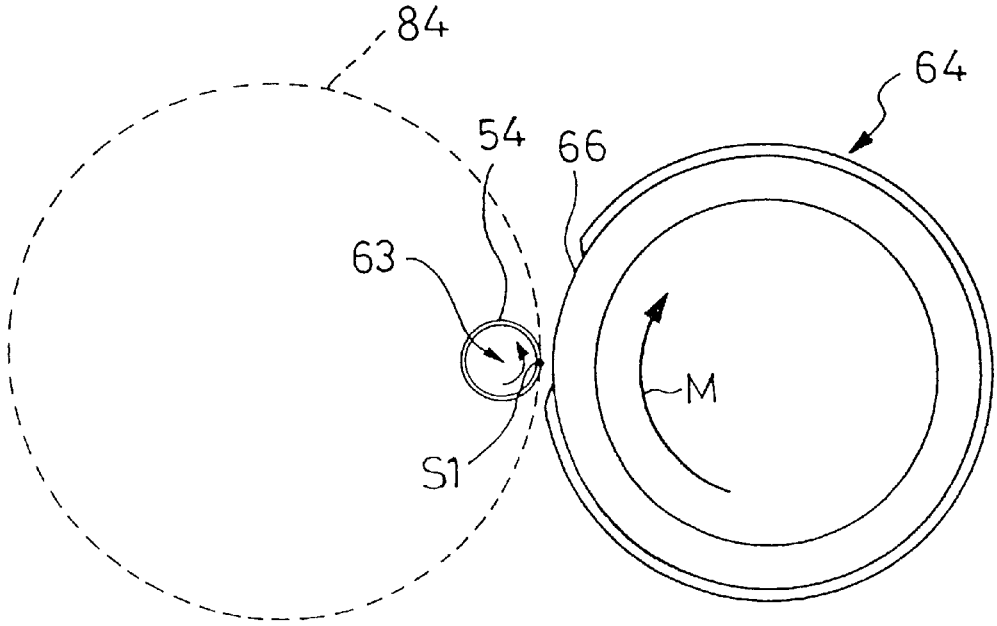
FIG. 9B is an explanatory view showing a positional relation between the organic photoconductor 54 and the dent portion 66 in the state after the organic photoconductor 54 reaches at a constant rotation speed.

Hereinafter, the function of the dent portion 66 will be described with reference to FIG. 9A and FIG. 9B showing positional relations between the organic photoconductor 54 and the dent portion 66 until the state where the organic photoconductor 54 reaches at a constant rotation speed.

The organic photoconductor 54 for magenta shown in FIG. 9A is stationary immediately after reaching at the image forming position 63. A point on the surface of the outer periphery of the organic photoconductor 54 is shown as S1 in FIG. 9A. At the time shown in FIG. 9A, the organic photoconductor 54 faces to the dent portion 66 without contacting to the transfer drum 64. Accordingly, the flaw caused by the above-mentioned peripheral speed difference is not liable to generate on the organic photoconductor 54. Then, the organic photoconductor 54 for magenta starts rotation. At the time the organic photoconductor 54 for magenta reaches at the constant rotation speed, which is equal to the rotation speed of the transfer drum 64, the point S1 on the outer periphery surface moves according to the rotation of the organic photoconductor 54 as shown in FIG. 9B. Since there is no peripheral speed difference in the state shown in FIG. 9B, the flaw is not liable to generate by the contact of the organic photoconductor 54 and the transfer drum 64 at the time.

In the color electrophotographic apparatus of this third embodiment, the outer periphery length of the dent portion 66 is designed to be at least longer than the distance of the rotation movement of the transfer drum 64 in the time the organic photoconductor 54 located at the image forming position 63 reaches at the constant rotation speed from the stationary state. Accordingly, the organic photoconductor 54 does not come in contact with the transfer drum 64 until the organic photoconductor 54 reaches at the constant rotation speed. Therefore, generation of the flaw on the organic photoconductor 54 caused by the peripheral speed difference between the organic photoconductor 54 and the transfer drum 64 can be prevented.

Thus, the dent portion 66 has a length obtained by adding the distance between the position where the organic photoconductor 54 comes in contact with the outer periphery portion of the transfer drum 64 and the position where the organic photoconductor 54 is located at the image forming position 63, and the distance of the rotation drum 64 moved by rotation in the time the organic photoconductor 54 located at the image forming position 63 reaches at the constant rotation speed from the stationary state. Accordingly, the generation of the flaw on the organic photoconductor 54 caused by the collision with the transfer drum 64 and the flaw on the organic photoconductor 54 caused by the peripheral speed difference with the transfer drum 64 can be prevented.

When the image forming unit 52M for magenta reaches at the image forming position 63 and the organic photoconductor 54 thereof reaches at the constant rotation speed, the laser signals 59 for the magenta toner image are irradiated from the laser exposure device 58 to the image forming unit 52M for magenta. Accordingly, the magenta toner image is formed and transferred on the paper sheet 73. The transfer drum 64 is rotated by one turn by the time of completing the magenta toner image formation, and the laser signals 59 for the magenta and timing of starting writing are controlled so that the magenta toner image is superimposed on the transferred yellow toner image on the paper sheet 73.

The assembly of image forming units 53 is rotated by 80 degrees in the direction shown by the arrow "Q" in FIG. 5, so that the image forming unit 52C for cyan is located at the image forming position 63. As the image formation processes for yellow and magenta, the cyan toner image is formed on the paper sheet 73 with the image forming unit 52C for cyan.

Finally, the assembly of image forming units 53 is rotated by 80 degrees in the direction shown by the arrow "Q", so that the image forming unit 52BK for black is located at the image forming position 63. As the above-mentioned image formation processes, the black toner image is formed on the paper sheet 73.

Accordingly, the four color toner images are superimposed on the paper sheet 73 to form the full color image. The full color image is fixed by the fuser 72. Thereafter, the paper sheet 73 is discharged to the outside.

In the case that printing is conducted continuously, the assembly of image forming units 53 is rotated by 120 degrees in the direction shown by the arrow "Q", so that the image forming unit 52Y for yellow is located at the image forming position 63. That is, the color electrophotographic apparatus is in the initial state where a new full color image formation can be initiated.

Figure 10:
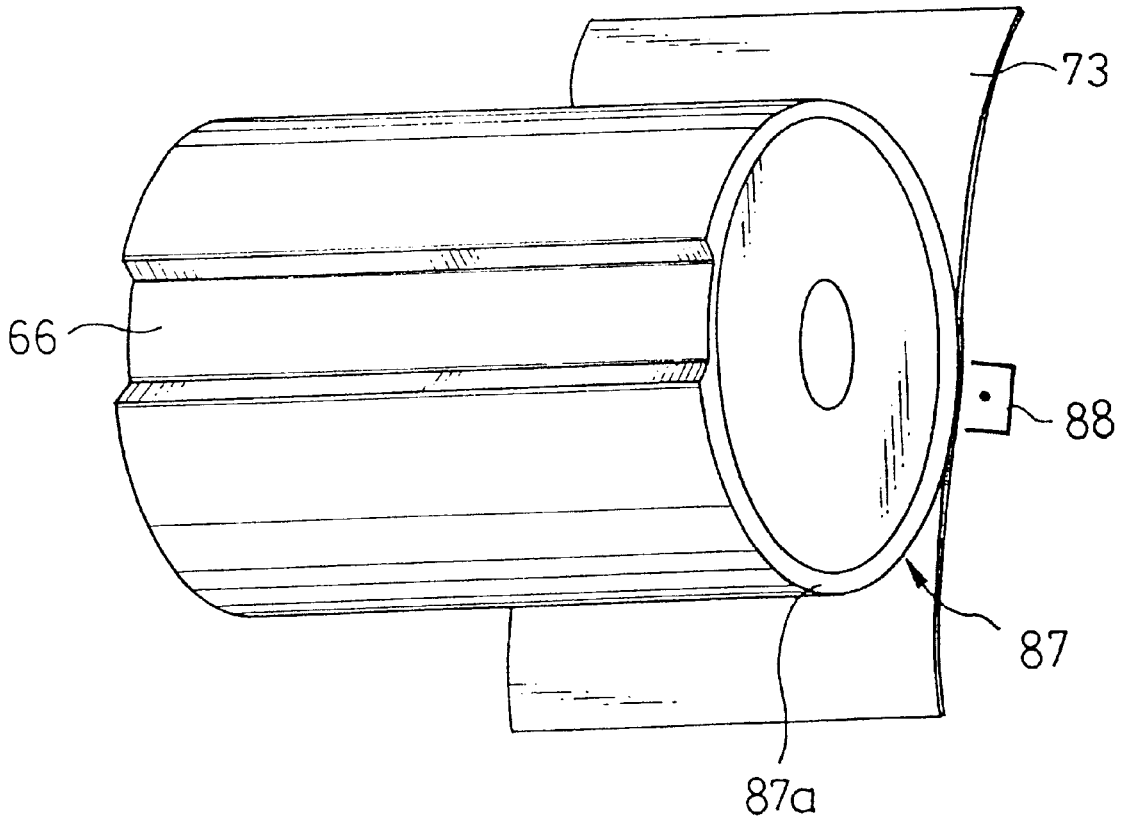
FIG. 10 is a perspective view showing an intermediate transfer drum equipped with the dent portion 66 of FIG. 5.

Generation of the flaw on an organic photoconductor 54 can be prevented by providing the above-mentioned dent portion 66 also in a color electrophotographic apparatus using an intermediate transfer drum as the image superimposing member. That is, y providing the dent portion 66 on the outer periphery surface portion of an intermediate transfer drum as shown in FIG. 10, the collision of the organic photoconductor 54 and the intermediate transfer drum 87 can be prevented at the time the assembly of the image forming units 53 (FIG. 5) rotates. In the intermediate transfer drum 87, the four color toner images are successively transferred on a high resistance layer 87*a* comprising a dielectric substance formed on the surface by applying the transfer bias voltage. After the formation of the full color image on the high resistance layer 87*a*, the full color image is transferred onto the paper sheet 73 by a transfer unit 88 at a time.

The case of forming the full color image on an acceptor sheet, to which a toner cannot attach well, such as transparencies for an overhead projector will be explained with reference to FIG. 11.

Figure 11:
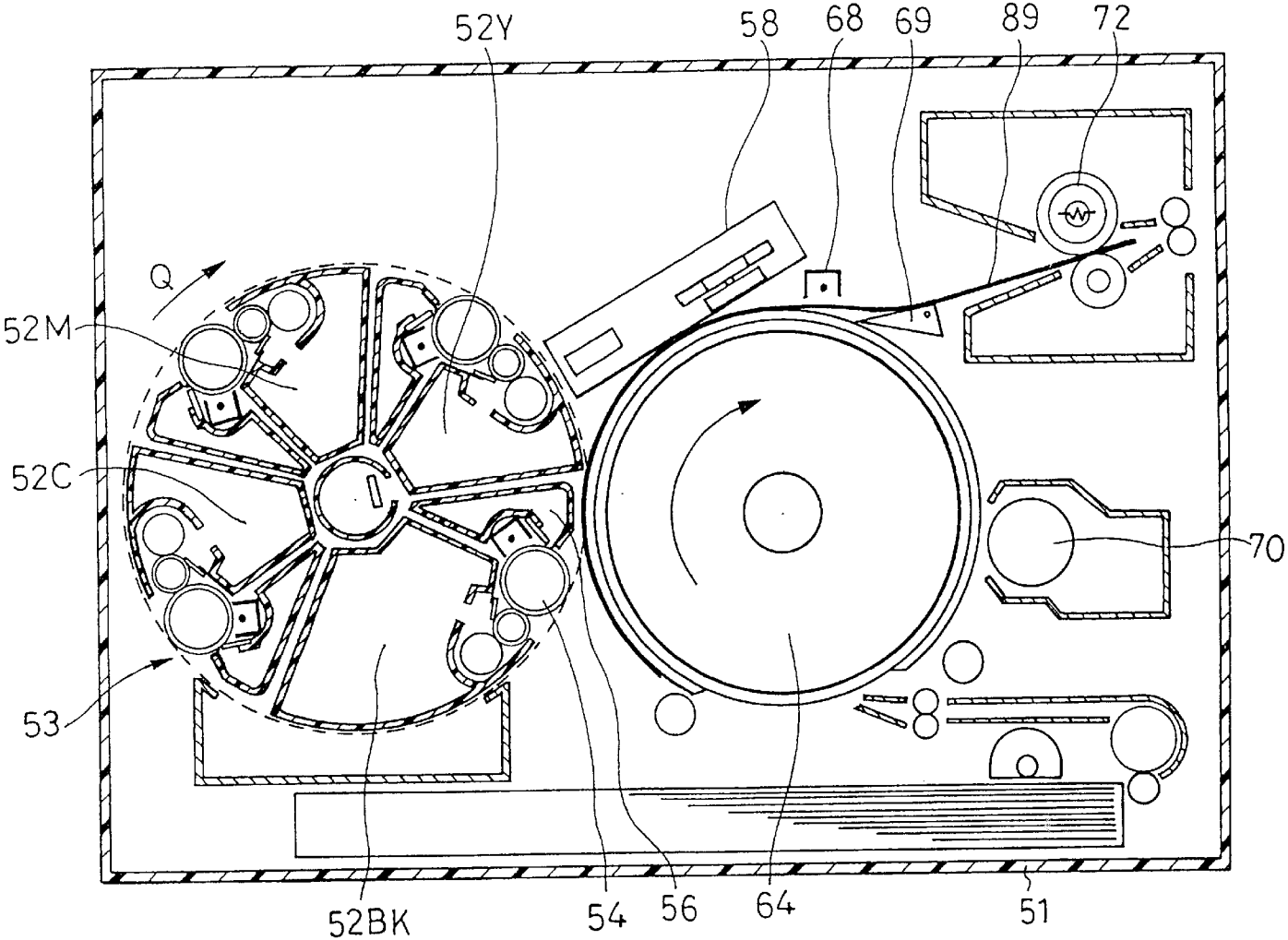
FIG. 11 is an explanatory view showing operation in forming the image on an acceptor sheet, to which a toner cannot attach well, in the color electrophotographic apparatus shown in FIG. 5.

FIG. 11 is an explanatory view showing operation in forming the image on an acceptor sheet, to which a toner cannot attach well, in the color electrophotographic apparatus shown in FIG. 5.

In the four image formation processes from yellow to black in FIG. 11, the full color image is formed on a transparency 89 with each of the organic photoconductor 54 and the transfer drum 64 rotating at a usual rotation speed of 100 mm/s. Then, immediately after completing the transfer of the black toner image, the rotation speed of the transfer drum 64 and the fuser 72 is changed to a second rotation speed of 25 mm/s, which is one-fourth of the usual speed. At the same time, rotation of the organic photoconductor 54 is stopped.

At the time if the organic photoconductor 54 contacts with the transfer drum 64 in the stationary state, a conspicuous flaw is generated on the organic photoconductor 54 due to the peripheral speed difference between the organic photoconductor 54 and the transfer drum 64. Therefore, the cleaner portion 56 of the image forming unit 52BK for black faces to the transfer drum 64 by the rotation of the assembly of the image forming units 53. As described with reference to FIG. 6A, the cleaner portion 56 is dented with respect to the surface of the organic photoconductor 54 by the gap G1 of 5 mm. Accordingly, the surface of the transfer drum 64 does not come in contact with the cleaner portion 56, so that the generation of the flaw on the surface of the organic photoconductor 54 can be prevented. Furthermore, disturbance of the toner image on the transparency 89 by the contact with the organic photoconductor 54 can be prevented as well. As has been explained in the above, the toner can be attached completely on the transparency 89, and thereby the full color image is improved permeability.

As mentioned above, in the color electrophotographic apparatus of this third embodiment, the assembly of the image forming unit 53 moves to the position not in contact with the transfer drum 64 at the time the transfer drum 64 rotates at the second rotation speed. Therefore, the generation of the flaw on the surface of the organic photoconductor 54 can be prevented.

Configurations of the organic photoconductor 54, the transfer drum 64, and the developing roller 76 will be explained in detail with reference to FIG. 12.

Figure 12:
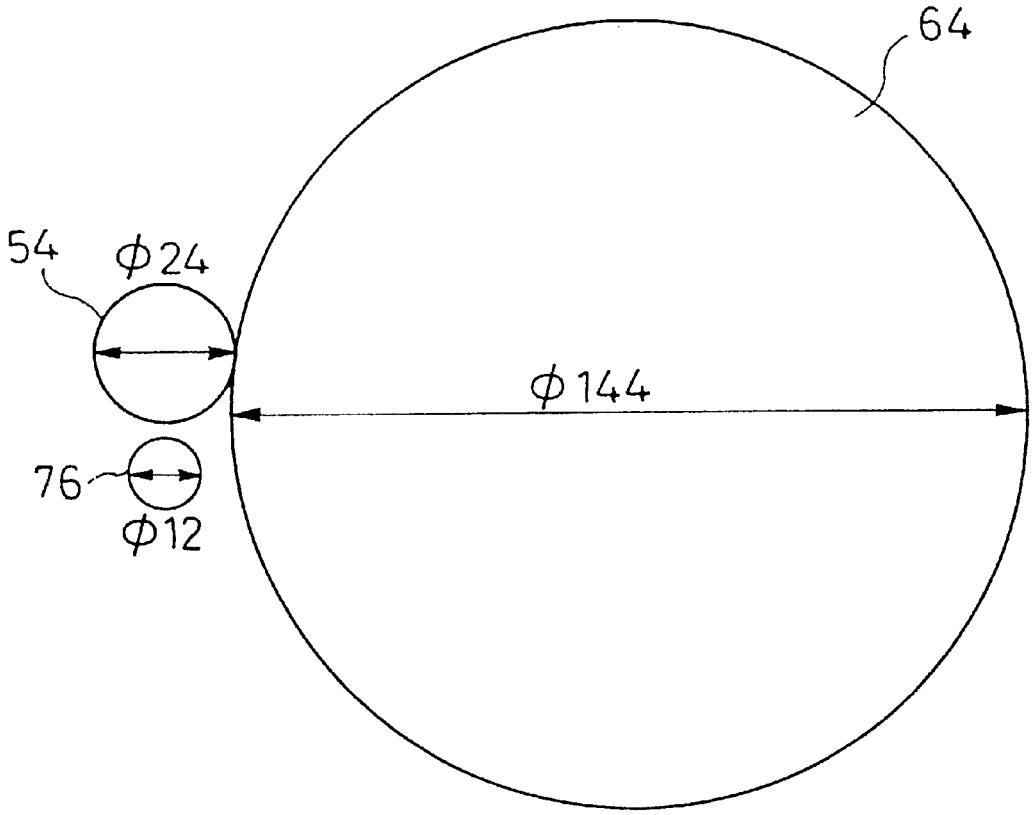
FIG. 12 is an explanatory view showing diameters of the organic photoconductor 54, the transfer drum 64, and the developing roller 76 shown in FIG. 5.

FIG. 12 is an explanatory view showing diameters of the organic photoconductor 54, the transfer drum 64, and the developing roller 76 shown in FIG. 5.

As shown in FIG. 12, in the color electrophotographic apparatus of this third embodiment, in terms of the diameter size, the developing roller 76, the organic photoconductor 54, and the transfer drum 64 can be put as it is in ascending order with a ratio represented with integers, that is, 1:2:12 (=12 mm:24 mm:144 mm). In other words, the outer periphery length of the developing roller 76 is designed to be half of the outer periphery length of the organic photoconductor 54, and the outer periphery length of the organic photoconductor 54 is designed to be one-sixth of the outer periphery of the transfer drum 64.

The configuration is applied since the jumping developing method by flying the non-magnetic mono-component toner is used in the color electrophotographic apparatus of this third embodiment unlike the first and second embodiments where the two-component magnetic blush developing method is used. In the jumping developing method, as described with reference to FIG. 6A, the organic photoconductor 54 is developed by flying the toner on the surface of the developing roller 76 to the surface of the organic photoconductor 54 facing to the toner by the alternating electrical field from the developing roller 76. In the jumping developing method, as already known, the electric charge amount of the toner is adjusted to be a very low level compared with the toner used in the two-component magnetic blush developing method in order to facilitate flying of the toner. Concretely, in the two-component magnetic blush developing method, the electric charge amount of the toner charged with a carrier is adjusted to be −10 to 30 $\mu$C/g. On the other hand, in the jumping developing method, the electric charge amount of the toner charged with the friction with the supply roller 77 (FIG. 6A) is adjusted to be −3 to 5 $\mu$C/g.

Accordingly, in the case of using the jumping developing method, there is a liability of having an unclear toner image since a toner tends to scatter compared with the two-component magnetic blush developing method when the toner is transferred from the organic photoconductor 54 to the transfer drum 64. For example, in the case of printing letters, the image quality may deteriorate by having blurred periphery portions.

With respect to the image quality deterioration caused by toner scattering, the present inventors found out through an experiment that as the diameter of the organic photoconductor 54 becomes smaller, the effect of curbing the toner scattering increases.

The effect of toner scattering reduction will be described with reference to FIGS. 13A and 13B.

Figure 13A:
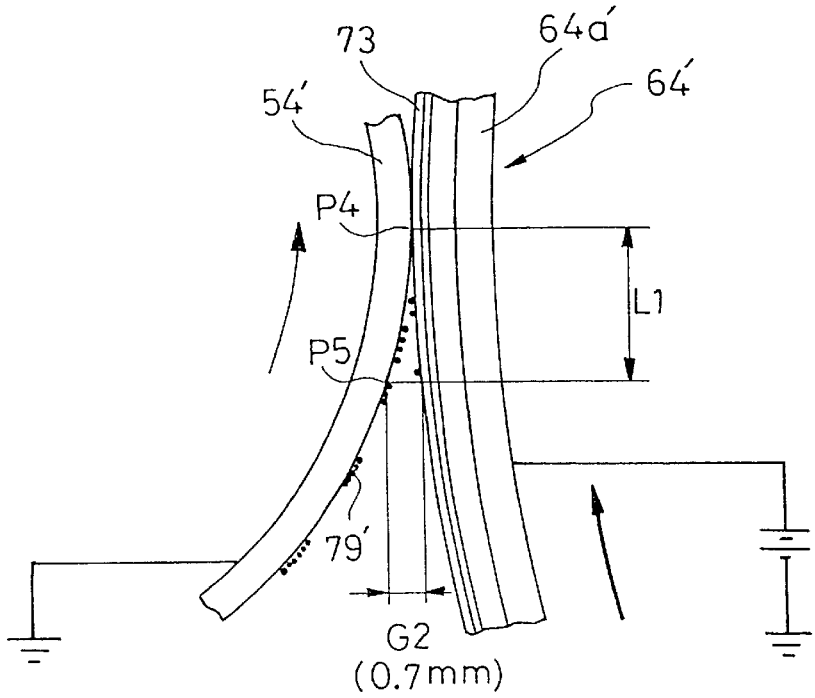
FIG. 13A is an explanatory view showing a contacting state of an organic photoconductor having a diameter of 40 mm or more and a transfer drum having a diameter of 144 mm.

FIG. 13A is an explanatory view showing a contacting state of an organic photoconductor having a diameter of 40 mm or more and a transfer drum having a diameter of 144 mm. FIG. 13B is an explanatory view showing a contacting state of an organic photoconductor having a diameter of 24 mm and a transfer drum having a diameter of 144 mm.

Figure 13B:
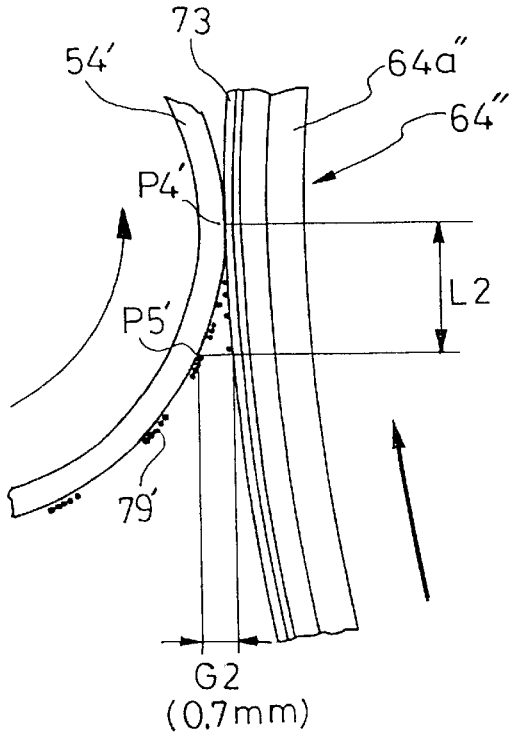
FIG. 13B is an explanatory view showing a contacting state of an organic photoconductor having a diameter of 24 mm and a transfer drum having a diameter of 144 mm.

In FIG. 13A and FIG. 13B, the diameters of the organic photoconductors 54' and 54" are 40 mm and 24 mm, respectively, and the diameter of the transfer drum 64' is 144 mm. Further, a voltage of +1 kV is applied to the drum main body 64*a*' of the transfer drum 64' as a test voltage. Therefore, a minus-charged toner 79' began flying from the surface of the organic photoconductor 54' or 54" to the paper sheet 73 at the point when the distance between the paper sheet 73 and the surface of the organic photoconductor 54' or 54" becomes equal to the gap "G2" (0.7 mm) in FIG. 13A and FIG. 13B.

In FIG. 13A, the distance "L1" between the contact position P4 of the organic photoconductor 54' and the paper sheet 73, and the surface position P5 of the organic photoconductor 54' at which the toner 79' began flying was about 3 mm. In the case with the organic photoconductor 54' with the diameter of 40 mm, the toner 79' scattered from the position to be placed, resulting in forming an unclear toner image on the paper sheet 73.

On the other hand, in FIG. 13B, the distance "L2" between the contact position P4' of the organic photoconductor 54" and the paper sheet 73, and the surface position P5' of the organic photoconductor 54" at which the toner 79' began flying was about 2.5 mm. In the case with the organic photoconductor 54" with the diameter of 24 mm, scattering of the toner 79' was not observed by eyes, and a clear toner image was transferred and formed on the paper sheet 73.

As mentioned above, in the case that the diameter size of the transfer drum 64 and the applied voltage for the transfer drum 64 are the same, a smaller diameter of the organic photoconductor 54 enabled a smaller distance between the contact position of the organic photoconductor 54 and the paper sheet 73, and the surface position of the organic photoconductor at which the toner began flying. Accordingly, toner scattering was prevented to achieve clear image formation.

Results of the above-mentioned experiment are shown in Table 1.

TABLE 1

| Sample No. | Diameter (d1) of the transfer drum 64 | Diameter (d2) of the organic photoconductor 54 | Ratio of d1 and d2 | Generation of scattering |
|---|---|---|---|---|
| 1 | 280 mm | 40 mm | 1/7 | No |
| 2 | 240 mm | 40 mm | 1/6 | No |
| 3 | 210 mm | 30 mm | 1/7 | No |
| 4 | 180 mm | 30 mm | 1/6 | No |
| 5 | 150 mm | 30 mm | 1/5 | No |
| 6 | 168 mm | 24 mm | 1/7 | No |
| 7 | 144 mm | 24 mm | 1/6 | No |
| 8 | 180 mm | 60 mm | 1/3 | Yes |
| 9 | 160 mm | 40 mm | 1/4 | Yes |
| 10 | 120 mm | 30 mm | 1/4 | Yes |
| 11 | 144 mm | 40 mm | 5/18 | Yes |

Furthermore, the present inventors confirmed that the toner scattering was not observed even in an image formation with a resolution of 400 dot per inch in the case the diameter of the organic photoconductor 54 is one-fifth or less of that of the transfer drum 64. Furthermore, it was learned that the ratio of the diameter of the organic photoconductor 54 and that of the transfer drum 64 is preferably represented by a ratio with integers of one-sixth or less for obtaining an image with a high resolution of 600 dot per inch or more.

Thus, in the color electrophotographic apparatus of this third embodiment, the clear image can be achieved with a simple configuration providing the organic photoconductor 54 with the diameter size of one-fifth or less with respect to the diameter of the transfer drum 64. Thereby, it is possible to prevent scattering of the toner with the low electric charge amount in the jumping developing method.

Furthermore, in the color electrophotographic apparatus of this third embodiment, the organic photoconductor 54 is developed after forming the non-magnetic toner thin film layer on the developing roller 76 by pressing with an elastic blade 78 (FIG. 6A) every the developing units 79Y, 79M, 79C, 79BK. Furthermore, in each of the developing units 79Y, 79M, 79C, 79BK, the developing roller 76 and the organic photoconductor 54 are rotated to the opposite directions, namely, to the directions shown by the arrows "V" and "W" in FIG. 6A, respectively, at the same peripheral speed (100 mm/s) at the time of the image formation. Therefore, there was a problem of liability of generating nonuniformity of image density caused by uneven rotation of the developing roller 76, that is so-called jitter, due to peripheral speed change of the developing roller 76 by the pressure from the elastic blade 78. Furthermore, there was another problem of liability of generating a flaw on the surface of the developing roller 76 by the pressure from the elastic blade 78, and the pressure flaw is transferred to the paper sheet 73 on the transfer drum 64 via the organic photoconductor 54. Moreover, if the color electrophotographic apparatus is left in an environment with a high temperature and a high humidity for a long time, deformation of the elastic blade 78 is liable to occur, resulting in the above-mentioned nonuniformity of image density or pressure flaw.

Such nonuniformity of image density or pressure flaw result in nonuniformity of hue since difference of hue of a synthesized color obtained by superimposing toner the images of different colors becomes larger. Particularly in the case that the cycles of uneven rotation of the developing rollers 76 differ from each other, the difference of hue of the synthesized color becomes conspicuous, resulting in generation of horizontal lines of an undesired color as the difference of hue. As a result, the image quality drastically deteriorates.

In order to prevent generation of the difference of hue, in the color electrophotographic apparatus of this third embodiment, as mentioned above, the outer periphery length of the developing roller 76 is configured to be half of the outer periphery length of the organic photoconductor 54, and the outer periphery length of the organic photoconductor 54 is configured to be one-sixth of the outer periphery of the transfer drum 64. Therefore, a generation cycle of the nonuniformity of image density or pressure flaw synchronizes with a rotation cycle of organic photoconductors 54 for successively transferred, or a rotation cycle of transfer drums 64. As a result, even in the case with uneven development or pressure flaw, they will appear not as the difference of hue but as the color density change on the image after synthesizing toner images. Accordingly, in the color electrophotographic apparatus of this third embodiment, the generation of the difference of hue and image quality deterioration can be prevented. In the color electrophotographic apparatus, in general, since the difference of the image is indicated with the difference of the hue, generation of color density change on the image will not cause a problem. For example, in the case a plurality of data designating different contents are displayed with different colors, the contents of the data can be displayed accurately with the color electrophotographic apparatus of this third embodiment owing to the feature preventing the generation of the difference of the hue.

Diameters of the developing roller 76, the organic photoconductor 54, and the transfer drum 64 are not limited to the figures mentioned above, but the generation of the difference of the hue can be prevented by satisfying the below-mentioned conditions (1) to (4). In a configuration using the organic photoconductor 54 and the transfer drum 64, a diameter and an outer periphery length are the same, but in a configuration using the intermediate transfer belt 3 shown in FIG. 1 or FIG. 4, a term "outer periphery" is appropriate.

(1) The developing roller and the organic photoconductor rotate substantially at the same peripheral speed to the opposite directions.

(2) The ratio of the outer peripheries of the developing roller and the organic photoconductor is represented with integers.

(3) The organic photoconductor and the transfer drum rotate substantially at the same peripheral speed to the opposite directions.

(4) The ratio of the outer peripheries of the organic photoconductor and the transfer drum is represented with integers.

Furthermore, in the color electrophotographic apparatus of this third embodiment, the assembly of the image forming units 53 (FIG. 5) rotates so that a next image forming unit to be located at the image forming position 63 (FIG. 5) moves substantially in the same direction as the gravity functions (shown by "Q" in FIG. 5). Effects of rotating the assembly of the image forming units 53 in such a way will be explained hereinafter.

In order to apparently show the above-mentioned effects, a configuration of a comparative color electrophotographic apparatus prepared by the inventors will be described with reference to FIG. 14. Explanation will be given mainly on the parts different from the color electrophotographic apparatus of this third embodiment. The parts having the same configuration will be applied with the same numerals shown in FIG. 5 and further description will not be provided.

Figure 14:
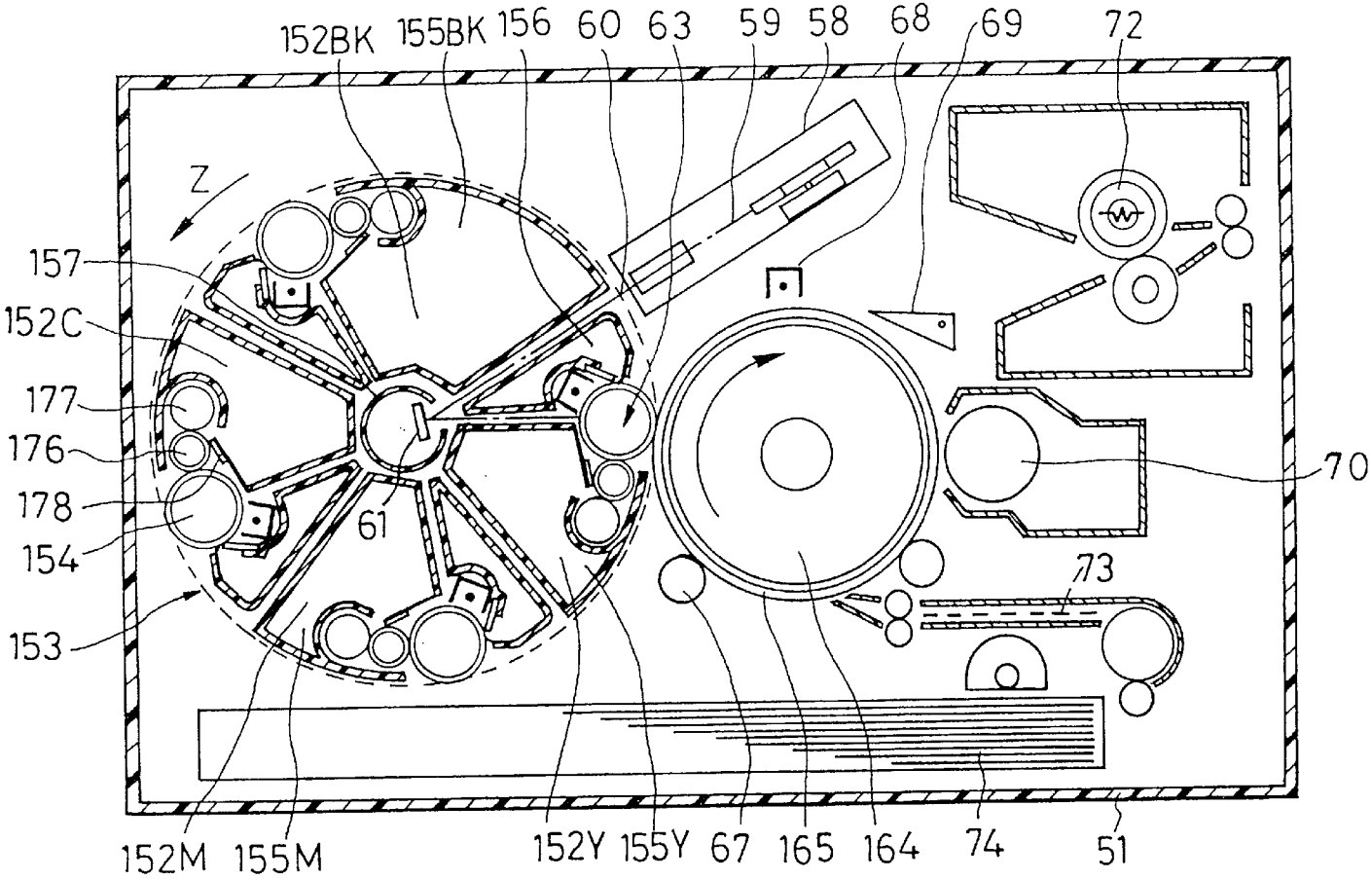
FIG. 14 is a side cross-sectional schematic view showing an entire configuration of a color electrophotographic apparatus prepared by the present inventors.

FIG. 14 is a side cross-sectional schematic view showing an entire configuration of a color electrophotographic apparatus prepared by the present inventors.

As shown in FIG. 14, the assembly of the image forming units 153 rotates so that a next image forming unit to be located at the image forming position 63 moves substantially in the opposite direction as the gravity functions. Concretely, the assembly of the image forming units 153 rotates in the counterclockwise direction as shown by an arrow "Z" in FIG. 14 around a cylindrical axis 151 fixed unrotatably on the outer case 51. Then, for example, an image forming unit 152M for magenta replaces an image forming unit 152Y for yellow, so that the image forming unit 152M for magenta is located at the image forming position 63.

In an experimental apparatus shown in FIG. 14, a dent portion 66 shown in FIG. 7A was not provided in the surface elastic layer 165 of the transfer drum 164. Therefore, in the experimental apparatus, the organic photoconductor 154 and the transfer drum 164 collided to each other whenever the assembly of the image forming units 153 rotates for replacing image forming units, resulting in damage of an organic photoconductor 154. Furthermore, in the case the organic photoconductor 154 and the transfer drum 164 differ in terms of peripheral speed, the organic photoconductor 154 was damaged in the experimental apparatus.

In the experimental apparatus, the blade protecting member 86 shown in FIG. 6A is not provided between the elastic blade and the agitator in the developing units 155M, 155C, 155Y, 155BK. Therefore, in the experimental apparatus, deformation of the elastic blade 178 or agglomeration of the toner was generated (details will be explained later).

Furthermore, in the experimental apparatus, the spilt toner reservoir 71 shown in FIG. 5 is not provided to the lower direction (the direction to which the gravity functions) of the assembly of the image forming units 153. Therefore, the toner dropped from the image forming units 152M, 152C, 152Y, 152BK scattered in the outer case 51 to ruin the inside.

The experimental apparatus differs from the color electrophotographic apparatus of this third embodiment mainly in the above-mentioned aspects.

By conducting a several thousands of color printing with the experimental apparatus, a problem in cleaning the organic photoconductor 154 occurred by the waste toner accumulated in the cleaner portion 156 of the image forming units 152M, 152C, 152Y, 152BK. Furthermore, the conspicuous flaw was generated on the organic photoconductor 154.

The cleaning problem and the flaw generation in the photoconductor in the image forming unit 155BK for black will be described in detail with reference to FIG. 15A, FIG. 15B, FIG. 16A, and FIG. 16B.

Figure 15B:
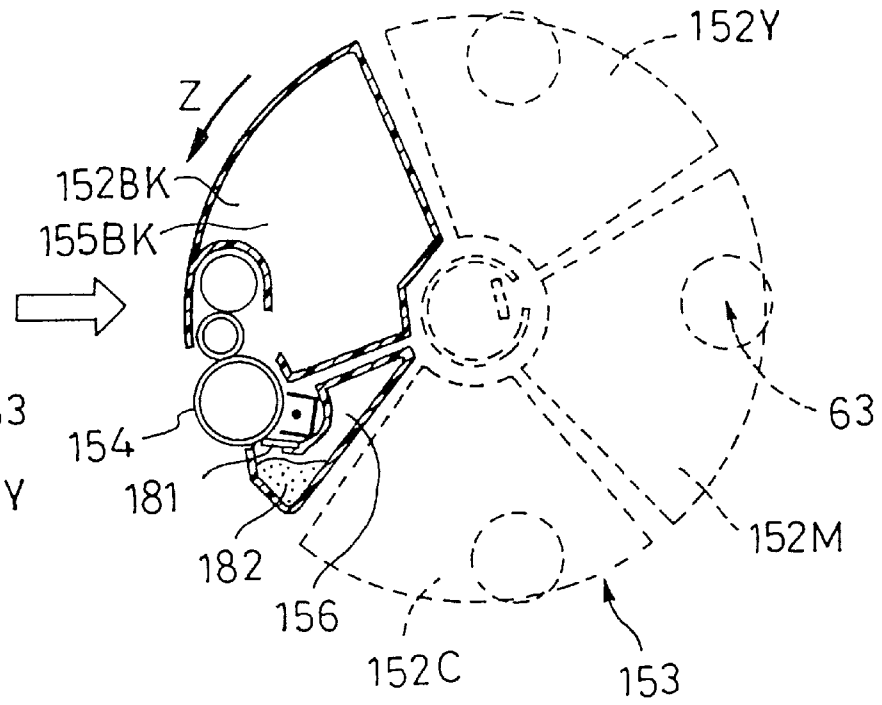
FIG. 15B is an explanatory view showing the state of the waste toner accumulated in the cleaner portion for black in the magenta image formation process in the experimental apparatus shown in FIG. 14.
Figure 15A:
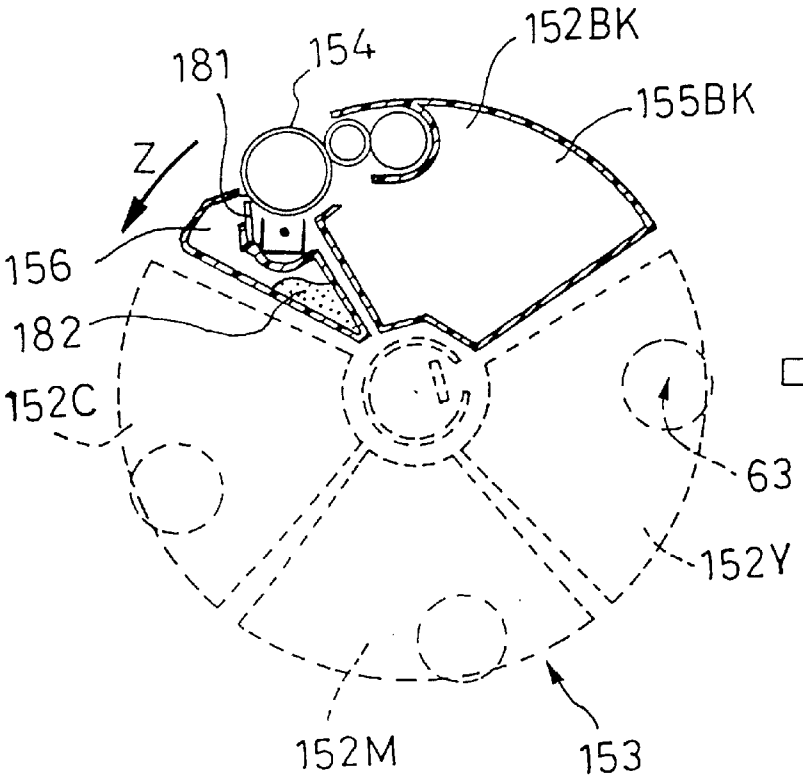
FIG. 15A is an explanatory view showing the state of the waste toner accumulated in the cleaner portion for black in the yellow image formation process in the experimental apparatus shown in FIG. 14.
Figure 16B:
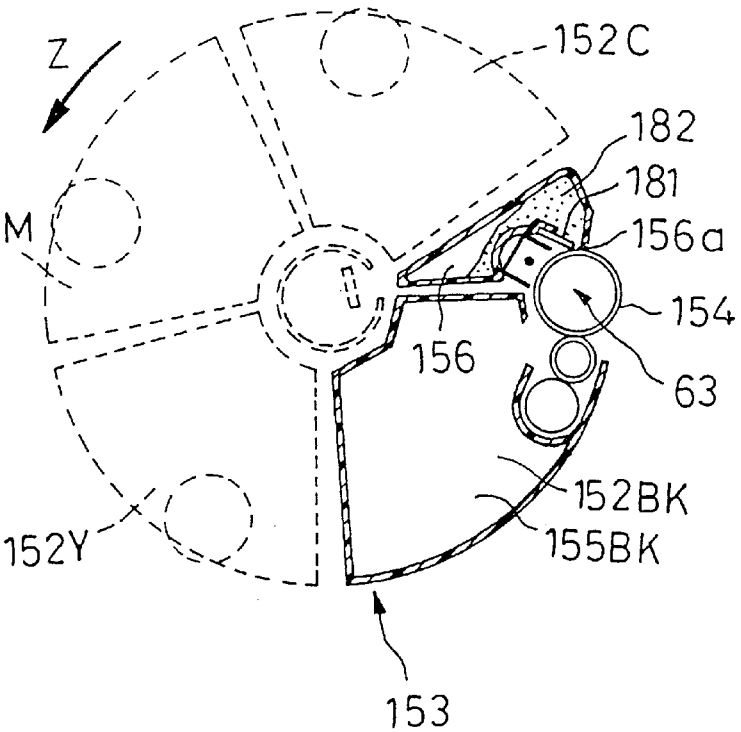
FIG. 16B is an explanatory view showing the state of the waste toner accumulated in the cleaner portion for black in the black image formation process in the experimental apparatus shown in FIG. 14.
Figure 16A:
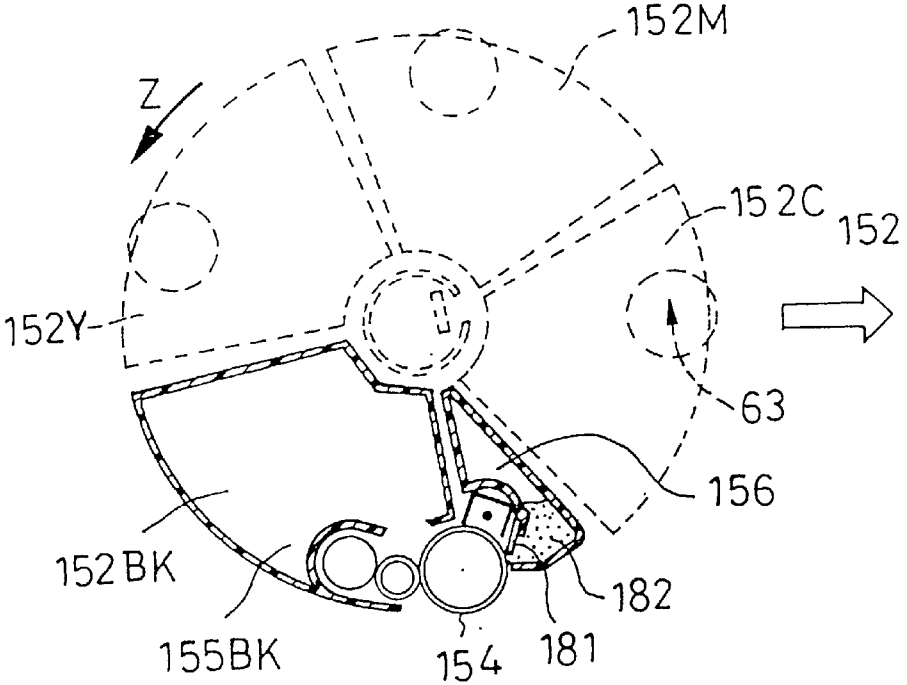
FIG. 16A is an explanatory view showing the state of the waste toner accumulated in the cleaner portion for black in the cyan image formation process in the experimental apparatus shown in FIG. 14.

FIG. 15A is an explanatory view showing the state of the waste toner accumulated in the cleaner portion for black in the yellow image formation process in the experimental apparatus shown in FIG. 14. FIG. 15B is an explanatory view showing the state of the waste toner accumulated in the cleaner portion for black in the magenta image formation process in the experimental apparatus shown in FIG. 14. FIG. 16A is an explanatory view showing the state of the waste toner accumulated in the cleaner portion for black in the cyan image formation process in the experimental apparatus shown in FIG. 14. FIG. 16B is an explanatory view showing the state of the waste toner accumulated in the cleaner portion for black in the black image formation process in the experimental apparatus shown in FIG. 14. In FIG. 15A, FIG. 15B, FIG. 16A, FIG. 16B, the image forming units 152Y, 152M, 152C for yellow, magenta, cyan are shown by broken lines in order to simplify the drawing. The assembly of the image forming units 153 is rotated in the order of FIG. 15A, FIG. 15B, FIG. 16A, FIG. 16B, so that the image forming units 152Y, 152M, 152C, 152BK are successively located at the image forming position 63.

As shown in FIG. 15A, FIG. 15B, FIG. 16A, FIG. 16B, the waste toner 182 accumulated in the cleaner portion 156 of the image forming unit 152BK for black moves in the cleaner portion 156 to the direction in which the gravity functions according to the rotation of the assembly of the image forming units 153 shown by an arrow "Z". In the black image formation process, the waste toner is accumulated in the cleaner portion 156 as shown in FIG. 16B, giving a pressure onto the cleaning blade 181 from the upper direction. Besides, the waste toner 182 chokes the gap 156*a*, which is provided between the cleaner portion 156 and the cleaning blade 181 for collecting the toner on the organic photoconductor 154. Accordingly, the toner on the organic photoconductor 154 is not collected by the cleaner portion 156 through the gap 156*a*, resulting in poor cleaning of the organic photoconductor 154. Furthermore, due to the pressure by the cleaning blade 181, the flaw is generated in the organic photoconductor 154.

Thus, in the experimental apparatus, by conducting a several thousands of color printing, the cleaner portion 156 was not able to function properly due to the waste toner 182 accumulated in the cleaner portion 156, resulting in poor cleaning and generation of a flaw in the organic photoconductor 154.

On the other hand, the color electrophotographic apparatus of this third embodiment differs from the experimental apparatus with the above-mentioned problems in the rotation direction of the assembly of the image forming units 53 (FIG. 5). Thereby, the poor cleaning caused by the waste toner 82 (FIG. 6A) or the generation of the flaw in the organic photoconductor (FIG. 5) can be prevented.

Effects on the waste toner 82 accumulated in the cleaner portion 56 of the image forming unit 52BK for black will be explained with reference to FIG. 17A, FIG. 17B, FIG. 18A, FIG. 18B.

Figure 17B:
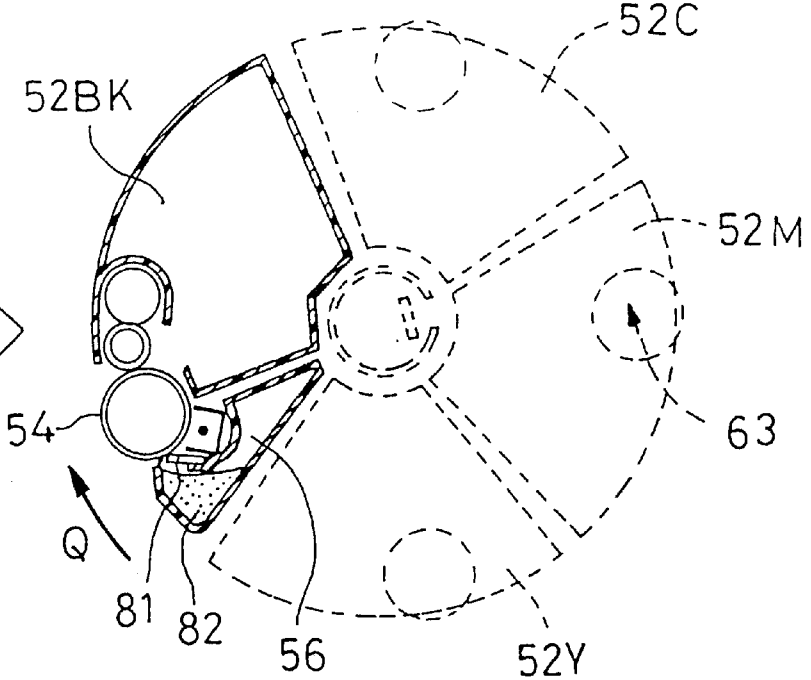
FIG. 17B is an explanatory view showing the state of the waste toner accumulated in the cleaner portion for black in the magenta image formation process in the color electrophotographic apparatus of the third embodiment.
Figure 17A:
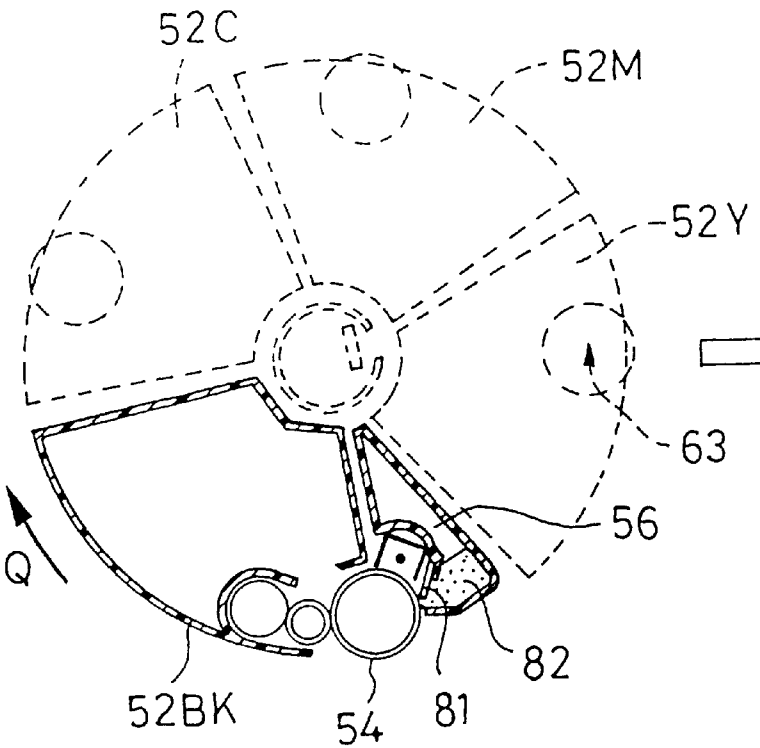
FIG. 17A is an explanatory view showing the state of the waste toner accumulated in the cleaner portion for black in the yellow image formation process in the color electrophotographic apparatus of the third embodiment.
Figure 18A:
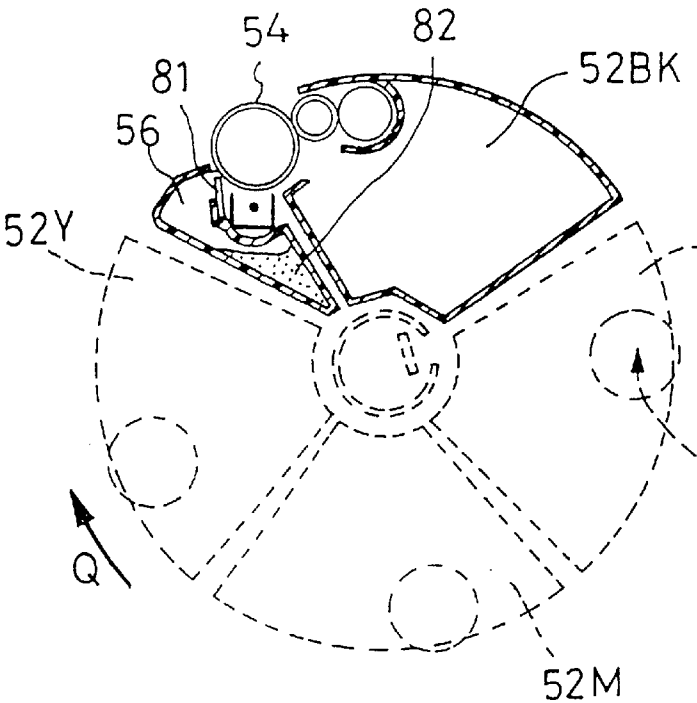
FIG. 18A is an explanatory view showing the state of the waste toner accumulated in the cleaner portion for black in the cyan image formation process in the color electrophotographic apparatus of the third embodiment.
Figure 18B:
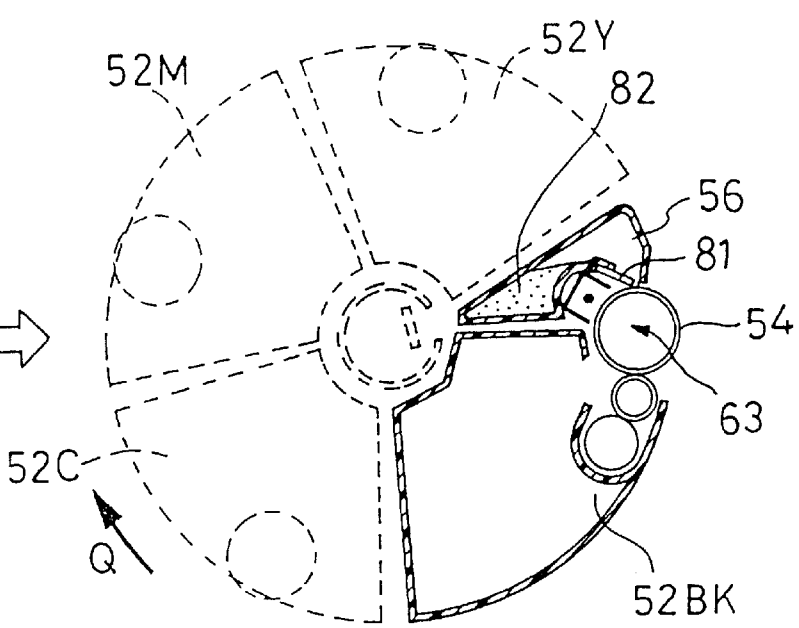
FIG. 18B is an explanatory view showing the state of the waste toner accumulated in the cleaner portion for black in a black image formation process in the color electrophotographic apparatus of the third embodiment.

FIG. 17A is an explanatory view showing the state of the waste toner accumulated in the cleaner portion for black in the yellow image formation process in the color electrophotographic apparatus of the third embodiment. FIG. 17B is an explanatory view showing the state of the waste toner accumulated in the cleaner portion for black in the magenta image formation process in the color electrophotographic apparatus of the third embodiment. FIG. 18A is an explanatory view showing the state of the waste toner accumulated in the cleaner portion for black in the cyan image formation process in the color electrophotographic apparatus of the third embodiment. FIG. 18B is an explanatory view showing the state of the waste toner accumulated in the cleaner portion for black in a black image formation process in the color electrophotographic apparatus of the third embodiment. In FIG. 17A, FIG. 17B, FIG. 18A, FIG. 18B, the image forming units 52Y, 52M, 52C for yellow, magenta, cyan are shown by dashed lines in order to simplify the drawing. The assembly of the image forming units 53 is rotated in the order of FIG. 17A, FIG. 17B, FIG. 18A, FIG. 18B, so that the image forming units 52Y, 52M, 52C, 52BK are successively located at the image forming position 63.

As shown in FIG. 17A, FIG. 17B, FIG. 18A, FIG. 18B, the waste toner 82 accumulated in the cleaner portion 56 of the image forming unit 52BK for black moves in the cleaner portion 56 to the direction in which the gravity functions according to the rotation of the assembly of the image forming units 53 shown by the arrow "Q". As shown in FIG. 18B, the waste toner 82 is not accumulated on a position to press the cleaning blade 81 from the upper direction at the time the image forming unit 52BK is located at the image forming position 63. Accordingly, the poor cleaning caused by the waste toner 82 or the flaw on the organic photoconductor is not liable to generate.

Thus, in the color electrophotographic apparatus of this third embodiment, the assembly of the image forming units 53 rotates so that the cleaner portion 56 of a next image forming unit to be located at the image forming position 63 moves in substantially the same direction as the gravity functions. Therefore, even after conducting the several thousands of color printing, the problem in cleaning of the organic photoconductor 54 caused by the waste toner 82 accumulated in the cleaner portion 56 will not generate, and further, the flaw on the organic photoconductor can be prevented.

In the experimental apparatus shown in FIG. 14, in the case of printing after leaving in the environment with the high temperature and the high humidity for a few days, the flaw caused by the pressure of the elastic blade 178 was generated on the developing roller 176. In a more serious case, the elastic blade 178 was deformed, so that the thin film layer of the toner was not formed on the developing roller 176 uniformly. Moreover, toner friction with the supply roller 177 and a problem in charging occurred, resulting in generation of the above-mentioned nonuniformity of image density (image nonuniformity). The present inventors paid attention to the image forming unit 152Y for yellow, and strenuously studied the causes of these problems and sought for solutions.

Movement of a yellow toner 179Y in the developing unit 155Y for yellow in the experimental apparatus will be explained with reference to FIG. 19A, FIG. 19B, FIG. 20A, FIG. 20B.

Figures 19A, 19B:
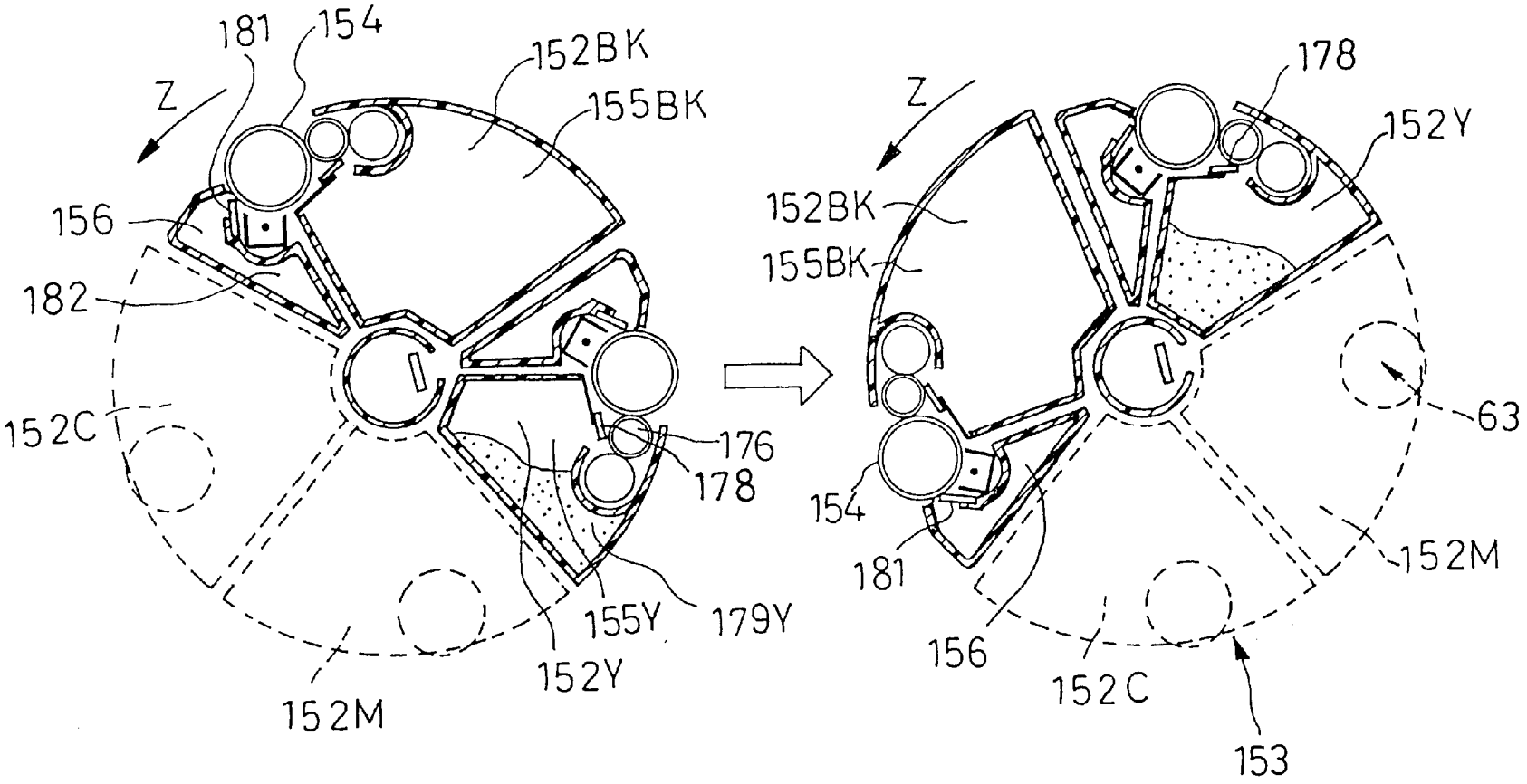
FIG. 19A is an explanatory view showing the state of a toner in the developing unit for yellow in the yellow image formation in the experimental apparatus shown in FIG. 14.
FIG. 19B is an explanatory view showing the state of the toner in the developing unit for yellow in the magenta image formation in the experimental apparatus shown in FIG. 14 .
Figure 20B:
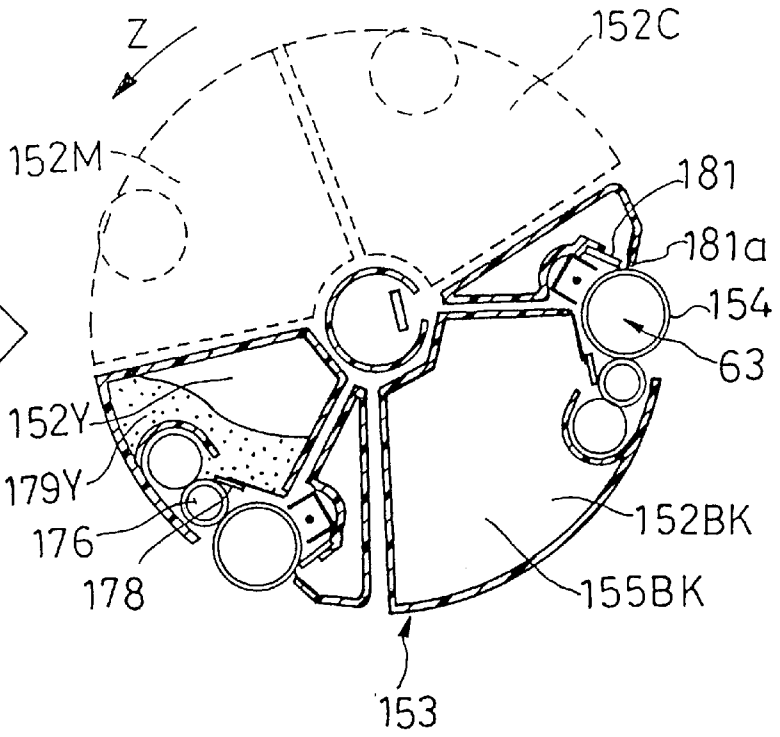
FIG. 20B is an explanatory view showing the state of the toner in the developing unit for yellow in the black image formation in the experimental apparatus shown in FIG. 14.
Figure 20A:
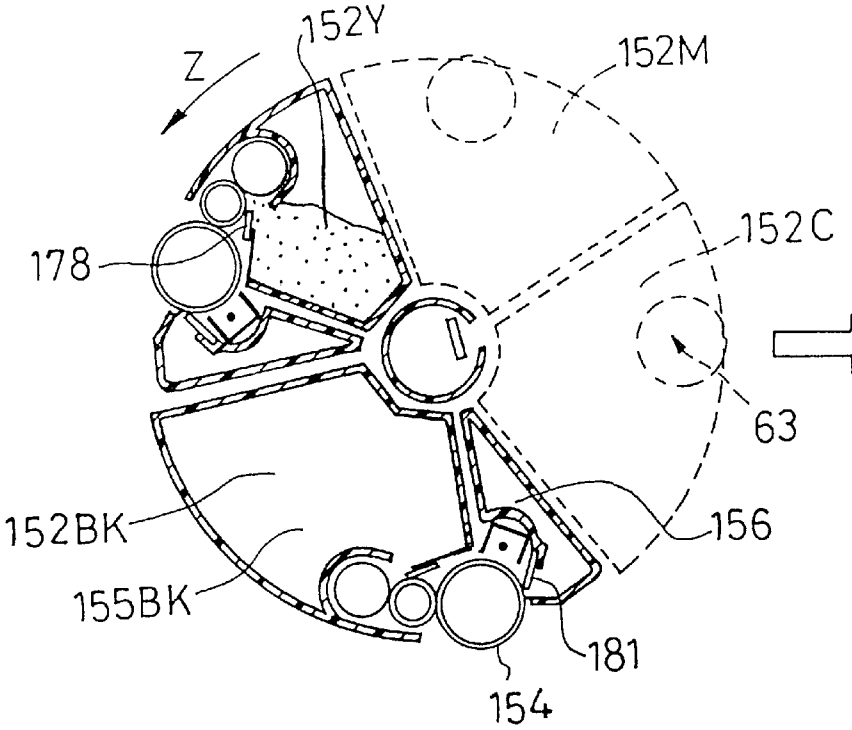
FIG. 20A is an explanatory view showing the state of the toner in the developing unit for yellow in the cyan image formation in the experimental apparatus shown in FIG. 14.

FIG. 19A is an explanatory view showing the state of a toner in the developing unit for yellow in the yellow image formation in the experimental apparatus shown in FIG. 14. FIG. 19B is an explanatory view showing the state of the toner in the developing unit for yellow in the magenta image formation in the experimental apparatus shown in FIG. 14. FIG. 20A is an explanatory view showing the state of the toner in the developing unit for yellow in the cyan image formation in the experimental apparatus shown in FIG. 14. FIG. 20B is an explanatory view showing the state of the toner in the developing unit for yellow in the black image formation in the experimental apparatus shown in FIG. 14. In FIG. 19A, FIG. 19B, FIG. 20A, FIG. 20B, the image forming units 152M, 152C for magenta, cyan are shown by dashed lines in order to simplify the drawing.

The assembly of the image forming units 153 is rotated in the order of FIG. 19A, FIG. 19B, FIG. 20A, FIG. 20B so that the image forming units 152Y, 152M, 152C, 152BK are successively located at the image forming position 63. Thereby, the toner images of yellow, magenta, cyan, black are transferred and formed in this order. As shown in FIG. 19A, FIG. 19B, FIG. 20A, FIG. 20B, the yellow toner 179Y in the developing unit 155Y of the image forming unit 152Y for yellow moves to the direction in which the gravity functions according to the rotation of the assembly of the image forming units 153 shown by the arrow "Z". In the case of not conducting printing continuously, rotation of the assembly of the image forming units 153 stops after completing the black toner image formation process. Accordingly, as shown in FIG. 20B, the yellow toner 179Y remains in the developing unit 155Y in the state of pressing the elastic blade 178. The experimental apparatus was left in such a state in the environment with the high temperature and the high humidity for a long time, then the above-mentioned problems of a flaw caused by the pressure of the elastic blade 178 or deformation occurred.

The above-mentioned problems will be described in detail with reference to FIG. 21A, FIG. 21B.

Figure 21A:
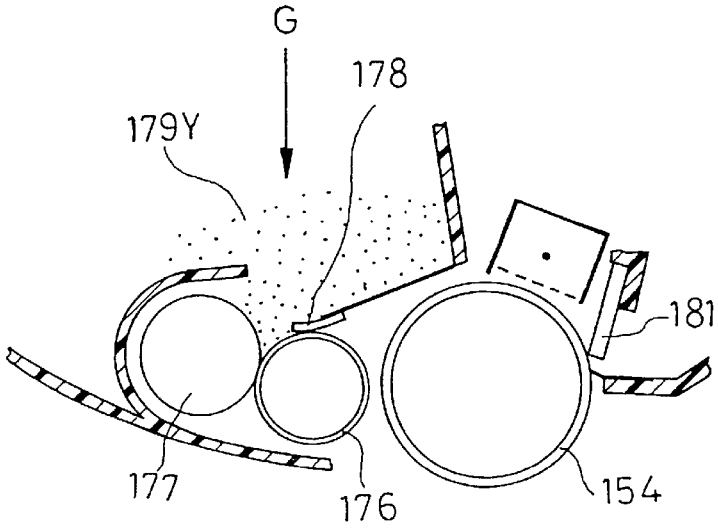
FIG. 21A is a partially enlarged view of the vicinity of the developing roller of the image forming unit for yellow in the state shown in FIG. 20B.

FIG. 21A is a partially enlarged view of the vicinity of the developing roller of the image forming unit for yellow in the state shown in FIG. 20B. FIG. 21B is a partially enlarged view showing the state of the yellow toner agglomerate in the experimental apparatus shown in FIG. 14 when the image forming unit for yellow is located at the image forming position.

In the state shown in FIG. 21A, the total amount of the yellow toner 179Y in the developing unit 155Y is concentrated in the vicinity of the developing roller 176. Therefore, the elastic blade 178 is pressed in the direction to which the gravity functions (direction shown by an arrow "G" in the drawing) by the yellow toner 179Y. As mentioned above, the elastic blade 178 is formed with the urethane rubber. Therefore, if the elastic blade 178 is pressed in the state with the high humidity, permanent deformation with the rubber degeneration is liable to occur. Furthermore, the polyester resin is used as the toner in place of a conventional styrene acrylic resin. The specific gravity of the polyester resin is 1.2, which is larger than that of the styrene acrylic resin of 1.05. Moreover, since the toner comprising fine particles of 8 $\mu$m or smaller is used, the flowability of the toner is low and the pressure on the elastic blade 178 caused by the toner is larger with respect to a conventional toner comprising fine particles of 8 $\mu$m or larger.

A monochrome electrophotographic apparatus can be designed to avoid a configuration having the image forming unit where the toner does not press the elastic blade. However, in the case of the color electrophotographic apparatus, either one of the four image forming units need to be arranged in the state shown in FIG. 20B in order to miniaturize the apparatus.

Figure 21B:
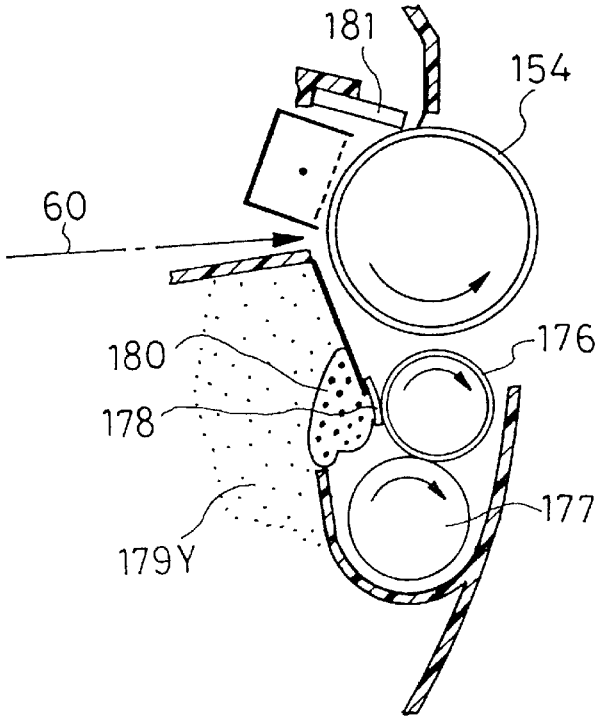
FIG. 21B is a partially enlarged view showing the state of the yellow toner agglomerate in the experimental apparatus shown in FIG. 14 when the image forming unit for yellow is located at the image forming position.

Besides, in the case that the toner is stored in the state with the high temperature and the high humidity, fine particles of the toner adhere to each other to form an agglomerate 180 shown in FIG. 21B. If the agglomerate 180 is formed, supply of the yellow toner 179Y from the toner hopper to the supply roller 177 is disturbed by the agglomerate 180 in the image formation of the image forming unit 152Y. As a result, insufficient supply of the yellow toner 179Y to the developing roller 177 occurs, resulting in defect with shortage of the color in the image.

On the other hand, in the color electrophotographic apparatus of this third embodiment, the blade protecting member 86 is provided between the elastic blade 78 and the agitator 85 as shown in FIG. 6A. Accordingly, even if the color electrophotographic apparatus is left in the environment with the high temperature and the high humidity for a long time, deformation of the elastic blade 78 or generation of defects such as uneven image can be prevented.

Effects of the blade protecting member 86 will be described with reference to FIG. 22A and FIG. 22B. In the below-mentioned explanation, the image forming unit 52Y for yellow will be described as in the case of FIG. 21A and FIG. 21B.

Figure 22A:
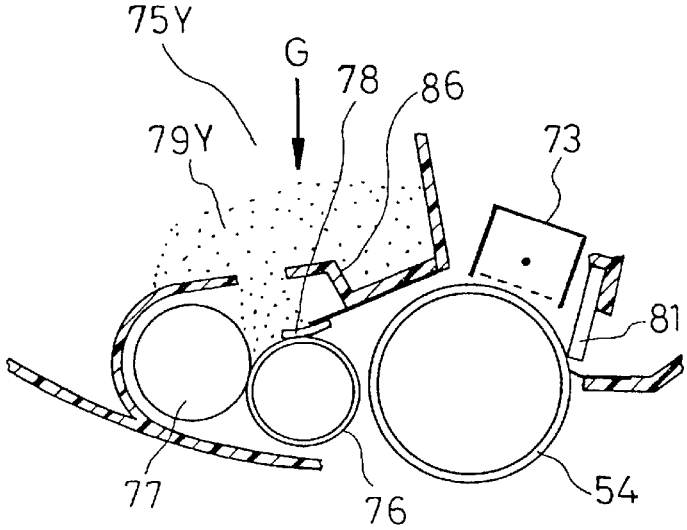
FIG. 22A is a partially enlarged view of the vicinity of the developing roller of the image forming unit for yellow of the color electrophotographic apparatus of the third embodiment in the state shown in FIG. 18B.

FIG. 22A is a partially enlarged view of the vicinity of the developing roller of the image forming unit for yellow of the color electrophotographic apparatus of the third embodiment in the state shown in FIG. 18B. FIG. 22B is a partially enlarged view of the vicinity of the developing roller of the image forming unit for yellow of the color electrophotographic apparatus of the third embodiment in the state when the image forming unit for yellow is located at the image forming position.

As shown in FIG. 22A, the blade protecting member 86 is provided at a position opposite to the elastic blade 78 with respect to the direction to which the gravity functions (shown by an arrow "G" in the drawing). Accordingly, even when the image forming unit 52Y for yellow is located in a position where the developing roller 76 is at a position to which the gravity functions in the outer case 51 (FIG. 5), supply mount of the yellow toner 79Y from the toner hopper 75Y to press the elastic blade 78 can be controlled. As a result, the flaw by the pressure of the elastic blade 78 or the deformation can be prevented. Furthermore, the generation of image defect caused by agglomeration of the yellow toner 79Y can be prevented.

Figure 22B:
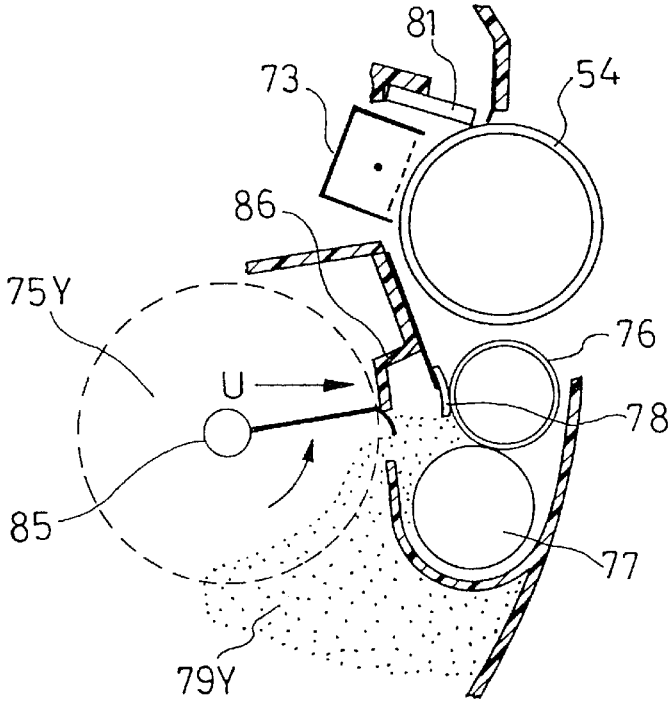
FIG. 22B is a partially enlarged view of the vicinity of the developing roller of the image forming unit for yellow of the color electrophotographic apparatus of the third embodiment in the state when the image forming unit for yellow is located at the image forming position.

Furthermore, as shown in FIG. 22B, in the case that the image forming unit 52Y for yellow is located at the image forming position 63 (FIG. 5), the blade protecting member 86 can control the supply amount of the yellow toner 79Y from the toner hopper 75Y by the agitator 85. That is, the supply pressure of the yellow toner 79Y functioning to the direction of an arrow "P" in the drawing can be reduced by the blade protecting member 86, and further, the pressure on the elastic blade 78 can be reduced as well. Moreover, since the supply amount of the yellow toner 79Y can be controlled, the generation of ununiformity of thickness of the toner thin film layer caused by rotation pitch fluctuation of the agitator 85 can be prevented, and thus consequently generation of ununiformity of image can be prevented.

Thus, in the color electrophotographic apparatus of this third embodiment, even in the case the apparatus is left in the environment with the high temperature and the high humidity for a long time, the deformation of the elastic blade 78 or the generation of defects such as ununiformity of the image can be prevented.

Furthermore, in the color electrophotographic apparatus of this third embodiment, as shown in FIG. 5, the spilt toner reservoir 71 is provided to the lower direction (to the direction in which the gravity functions) of the assembly of the image forming units 53.

Effects of the spilt toner reservoir 71 will be explained in detail with reference to FIG. 23.

Figure 23:
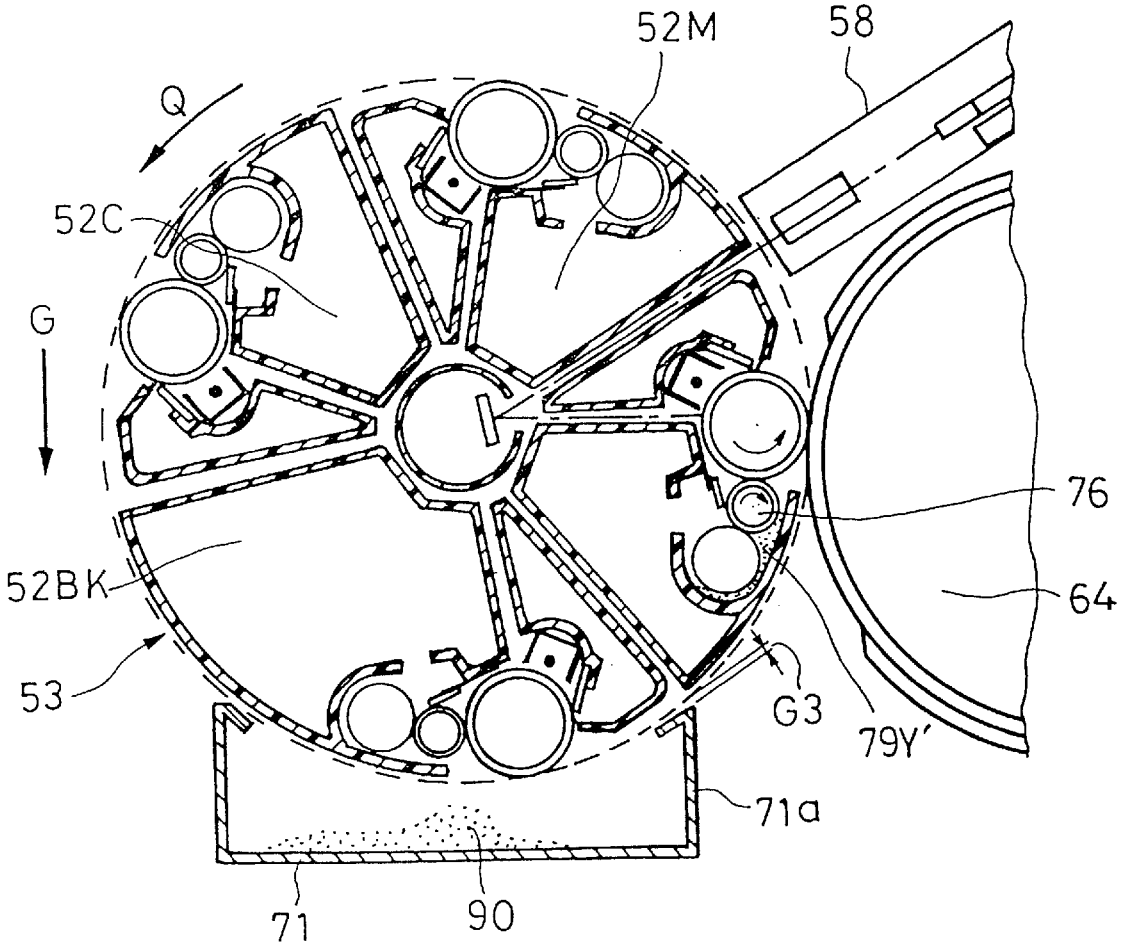
FIG. 23 is an explanatory view showing effects of a spilt toner reservoir of the color electrophotographic apparatus of the third embodiment.

FIG. 23 is an explanatory view showing effects of a spilt toner reservoir of the color electrophotographic apparatus of the third embodiment.

As has been explained in the above, in the color electrophotographic apparatus of the third embodiment, the non-magnetic mono-component toner is used. Therefore, a magnet cannot be used to provide a force for carrying the toner to the developing roller 76. Besides, the non-magnetic toner is an ideal toner with the low electric charge amount for the jumping developing method. Therefore, the toner is attached onto the developing roller 76 with a weak electrostatic force generated by the friction with the supply roller 77. Therefore, when the image forming unit 52Y for yellow is located at the image forming position 63 as shown in FIG. 23, the spilt toner 79Y' accumulates to the lower direction with respect to the developing roller 76 according to the rotation of the developing roller 76. In this state, the spilt toner 79Y' will not scatter to the outside owing to the outer case of the image forming unit 52Y.

However, when the assembly of the image forming units 53 rotates, the spilt toner 79Y' drops to the outside from the image forming unit 52Y through the gap between the inner walls of the developing roller 76 and the developing unit 55Y. Particularly, in the color electrophotographic apparatus of this third embodiment, a large assembly of the image forming units 53 rotates to generate a lot of vibration as well as the image forming units 52Y, 52M, 52C, 52BK rotates with alternately changing the upside and downside. Accordingly, the spilt toner 79' is liable to drop to the outside.

On the other hand, in the color electrophotographic apparatus of this third embodiment, the spilt toner reservoir 71 is provided to the lower direction, that is, the direction the same as the gravity functions (shown by an arrow "G" in the drawing), with respect to the image forming unit 53. Accordingly, in the color electrophotographic apparatus of this third embodiment, a dropped toner 90 from the image forming units 52Y, 52M, 52C, 52BK is received by the spilt toner reservoir 71, and thereby, it is possible to avoid to scatter the dropped toner 90 inside the outer case 51 (FIG. 5).

At the time, the dropped toner 90 does not always drop in the direction the same as the gravity functions due to the air flow subsequent to the rotation of the assembly of the image forming units 53. The scattering of the dropped toner 90 in the apparatus caused by the rotation of the assembly of the image forming units 53 can be effectively prevented with a configuration having a gap G3 between the side wall 71*a* of the spilt toner reservoir 71 and the assembly of the image forming units 53 of 2mm or less.

Figure 24:
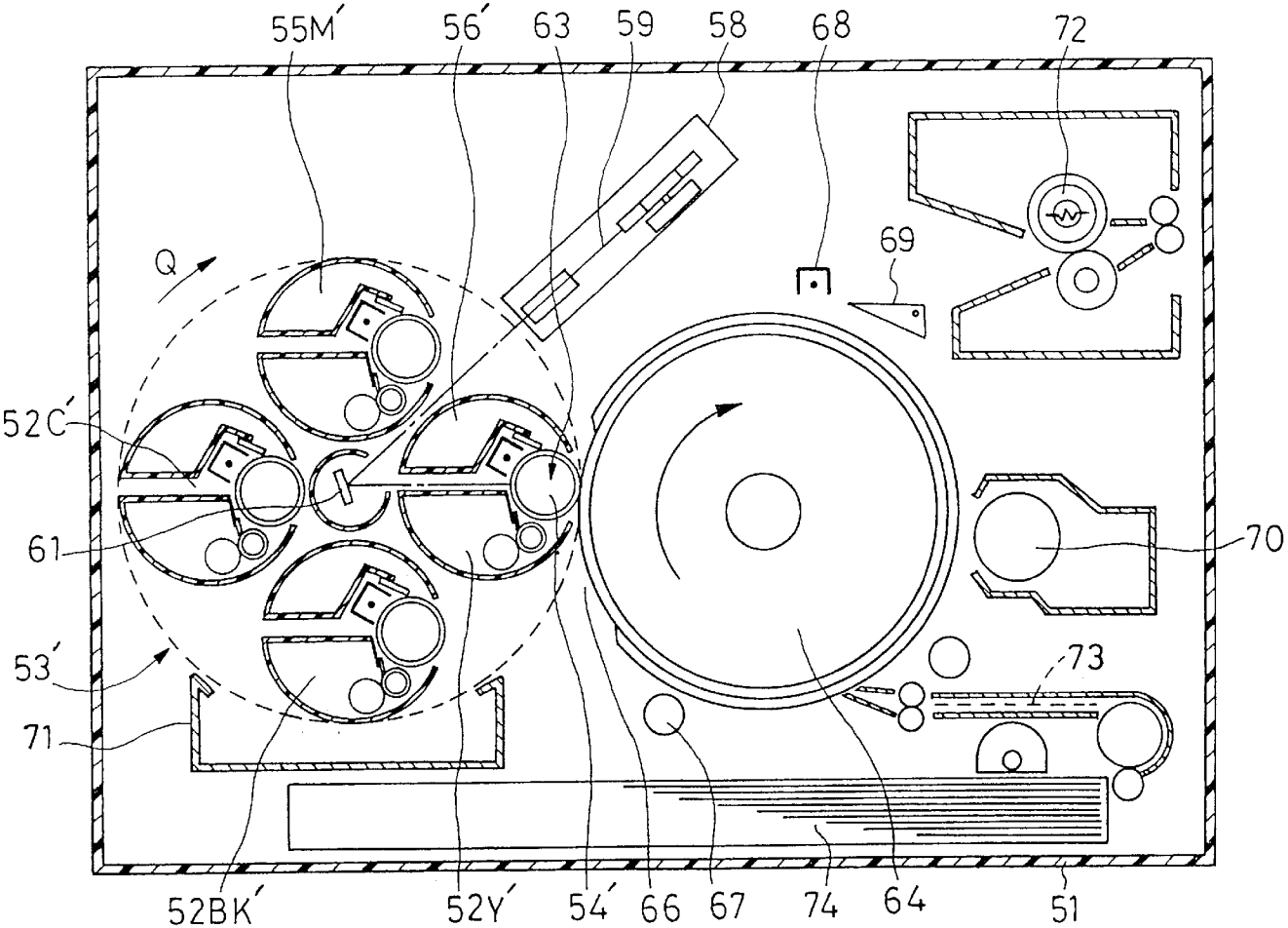
FIG. 24 is a side cross-sectional schematic view showing an entire configuration of a color electrophotographic apparatus in a modified version of third embodiment of the present invention, having the image forming units with a cylindrical cross-section.
Figure 25:
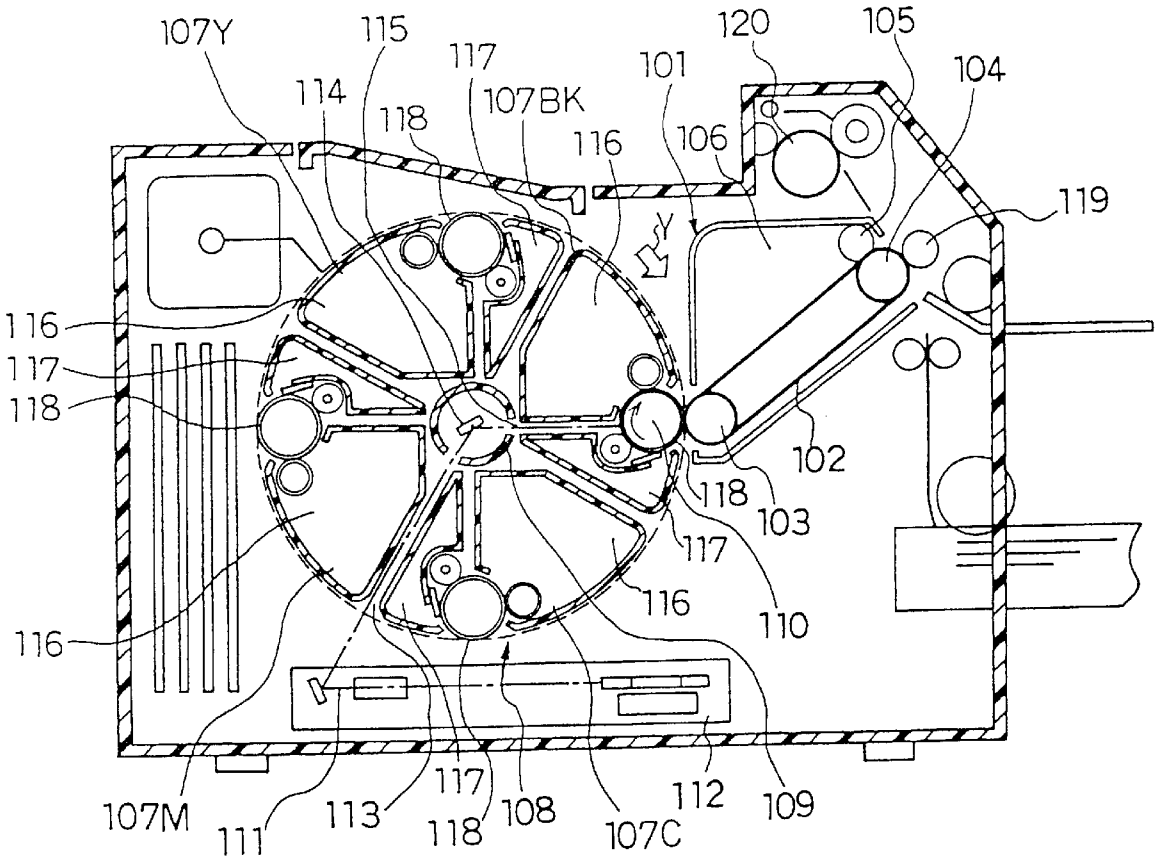
FIG. 25 (Prior Art)
FIG. 25 is a side cross-sectional schematic view showing an entire configuration of a conventional color electrophotographic apparatus.

As shown in FIG. 5, a configuration with four image forming units 52Y, 52M, 52C, 52BK having substantially sectorial shapes was explained, but it is also possible to have a configuration with the ratio of the outer peripheries of the developing roller 76, the organic photoconductor 54, the transfer drum 64 is represented with integers in the image forming units 52Y', 52M' 52C', 52BK' with a cylindrical cross-section shown in FIG. 24. Moreover, as shown in FIG. 24, it is also possible to provide the dent portion 66 in the transfer drum 64 and the spilt toner reservoir 71 to the lower direction with respect to the assembly of the image forming units 53'.

Although color electrophotographic apparatus comprising an assembly of four image forming units for yellow magenta, cyan, black have been explained, the same effects can be achieved in a color electrophotographic apparatus with an assembly of three or more image forming units by applying the technological concept of the present invention.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure.

Accordingly, it is intended that the appended claims be interpreted as covering all alterations and modifications as fall within the true spirit and scope of the invention.

What is claimed is:

1. A color electrophotographic apparatus comprising:

three or more image forming units for different colors, each of said three or more image forming units having a developing unit, and at least one of said image forming units provided with a central angle around a central axis different from that of the other image forming units, a rotatable assembly of image forming units having said three or more image forming units arranged radially, a photoconductor for having toner images formed thereon, an image superimposing member for forming a full color image by accepting respective toner images formed on said photoconductor, a laser exposure device for irradiating laser signals in accordance with the toner image to be printed, and a spilt toner reservoir having a side wall and located at a lowermost position with respect to the image forming units and for receiving dropped toner from an opening in each of said image forming units while said electrophotographic apparatus is forming said full color image, each of said image forming units being positioned with said opening facing the spilt toner reservoir when dropped toner is primarily transferred to said spilt toner reservoir, wherein said side wall extends generally upwardly toward said rotatable assembly to form a narrow gap between an edge of said side wall, positioned opposite from a receiving portion of the spilt toner reservoir, and an outer periphery of said rotatable assembly of image forming units for preventing scattering of dropped toner due to air flow caused by rotation of said rotatable assembly in order to retain dropped toner in said spilt toner reservoir.

2. The color electrographic apparatus of claim 1, wherein each of said image forming units is configured to be capable of moving between an image forming position for forming toner images on said photoconductor and a stopping position, where said opening is disposed to direct toner downward from about the lowermost portion of said rotatable assembly, said stopping position being on a downstream side from said image forming position with respect to a direction of movement of said image forming units, and said spilt toner reservoir being configured so that a distance between the lowermost portion of the outer periphery of said rotatable assembly and a receiving portion of said spilt toner reservoir is less than a length of said side wall as measured generally perpendicularly from the receiving portion, the distance between the receiving portion of the spilt toner reservoir and the lowermost portion of the outer periphery being greater than the height of said toner maintained in said spilt toner reservoir.

3. A color electrophotographic apparatus comprising:

three or more image forming units for different colors, each of said three or more image forming units having a developing unit, and at least one of said image forming units provided with a central angle around a central axis different from that of the other image forming units, a rotatable assembly of image forming units having said three or more image forming units arranged radially, a photoconductor for having toner images formed thereon, an image superimposing member for forming a full color image by accepting respective toner images formed on said photoconductor, a laser exposure device for irradiating laser signals in accordance with the toner image to be printed, and a spilt toner reservoir located at a lowermost position with respect to said image forming units, said spilt toner reservoir comprising:

a receiving portion for receiving dropped toner from an opening in each of said image forming units while each said opening is oriented to face the receiving portion, and a side wall configured to provide a gap between an edge of said side wall and an outer periphery of said rotatable assembly, said edge being positioned opposite from a receiving portion of said spilt toner reservoir, said gap being two millimeters or less.

4. The color electrographic apparatus of claim 3, wherein each of said image forming units is configured to be capable of moving between an image forming position for forming toner images on said photoconductor and a stopping position, where said opening is disposed to direct toner downward from about the lowermost position of said rotatable assembly, said stopping position being on a downstream side from said image forming position with respect to a direction of movement of said image forming units, and said spilt toner reservoir being configured so that the distance between the lowermost position of the outer periphery of said rotatable assembly and a receiving portion of said spilt toner reservoir is less than a length of said side wall as measured generally perpendicularly from the receiving portion, the distance between the receiving portion of the spilt toner reservoir and the lowermost portion of the outer periphery being greater than the height of said toner maintained in said spilt toner reservoir.

5. A color electrophotographic apparatus comprising:

three or more image forming units for different colors, each of said three or more image forming units having a developing unit, and at least one of said image forming units provided with a central angle around a central axis different from that of the other image forming units, a rotatable assembly of image forming units having said three or more image forming units arranged radially, a photoconductor for having toner images formed thereon, an image superimposing member for forming a full color image by accepting respective toner images formed on said photoconductor, a laser exposure device for irradiating laser signals in accordance with the toner image to be printed, and a spilt toner reservoir located at a lowermost position with respect to the image forming units and for receiving dropped toner form an opening in each of said image forming units, wherein each of said image forming units is configured to be capable of moving between an image forming position for forming toner images on said photoconductor and a stopping position, where said opening is disposed to direct toner downward from about the lowermost position of said rotatable assembly, said stopping position being on a downstream side from said image forming position with respect to a direction of movement of said image forming units, and said spilt toner reservoir comprises a receiving portion for receiving dropped toner from an opening in each of said image forming units and a side wall formed on a circumference of said receiving portion, said spilt toner reservoir being located generally opposite to the lowermost portion of said rotatable assembly of said image forming units, said spilt toner reservoir being configured so that a distance between the lowermost portion of the outer periphery of said rotatable assembly and the receiving portion is less than a length of said side wall as measured generally perpendicularly from said receiving portion, the distance between the receiving portion of the spilt toner reservoir and the lowermost portion of the outer periphery of the rotatable assembly being greater than the height of said toner maintained in said spilt toner reservoir.

6. The color electrographic apparatus of claim 5, wherein the side wall of said spilt toner reservoir is configured to provide a narrow gap between an edge of said side wall and the outer periphery of said rotatable assembly to prevent scattering of dropped toner due to air flow caused by the rotation of said rotatable assembly in order to receive dropped toner on said receiving portion, said edge being positioned opposite from a receiving portion of said spilt toner reservoir.

7. The color electrographic apparatus of claim 6, wherein said side wall of said spilt toner reservoir is disposed such that said narrow gap is two millimeters or less.

8. A color electrophotographic apparatus comprising:

three or more image forming units for different colors, each of said three or more image forming units having a developing unit, and at least one of said image forming units provided with a central angle around a central axis different from that of the other image forming units, a rotatable assembly of image forming units having said three or more image forming units arranged radially, a photoconductor for having toner images formed thereon, an image superimposing member for forming a full color image by accepting respective toner images formed on said photoconductor, a laser exposure device for irradiating laser signals in accordance with the toner image to be printed, and a spilt toner reservoir located at a lowermost position with respect to said image forming units and for receiving dropped toner from an opening in each of said image forming units while said full color image is being formed, wherein each of said image forming units is configured to be capable of moving between an image forming position for forming toner images on said photoconductor and a stopping position, where said opening is disposed to direct toner downward from about the lowermost portion of said rotatable assembly while the full color image is being formed, said stopping position being on a downstream side from said image forming position with respect to a direction of movement of said image forming units, and said split toner reservoir being positioned generally opposite to the lowermost portion of said rotatable assembly, the spilt toner reservoir being positioned so that said toner received therein does not contact said lowermost portion of the outer periphery of said rotatable assembly.

9. The color electrographic apparatus of claim 8, wherein a side wall of said spilt toner reservoir is configured to provide a narrow gap between an edge of said side wall and the outer periphery of said rotatable assembly to prevent scattering of dropped toner due to air flow caused by the rotation of said rotatable assembly in order to receive dropped toner on said receiving portion, said edge being positioned opposite from a receiving portion of said spilt toner reservoir.

10. The color electrographic apparatus of claim 8 wherein a side wall of said spilt toner reservoir is disposed to produce a gap of two millimeters or less between an edge of said side wall and an outer periphery of said rotatable assembly, said edge being positioned opposite from a receiving portion of said spilt toner reservoir.

11. A color electrophotographic apparatus comprising:

three or more image forming units for different colors, each of said three or more image forming units having a developing unit, and at least one of said image forming units provided with a central angle around a central axis different from that of the other image forming units, a rotatable assembly of image forming units having said three or more image forming units arranged radially, a photoconductor for having toner images formed thereon, an image superimposing member for forming a full color image by accepting respective toner images formed on said photoconductor, a laser exposure device for irradiating laser signals in accordance with the toner image to be printed, and a spilt toner reservoir located at a lowermost position with respect to the image forming units and for receiving dropped toner from an opening in each of said image forming units, wherein each of said image forming units is configured to be capable of moving between an image forming position for forming toner images on said photoconductor and a stopping position, where said opening is disposed to direct toner downward from about the lower most portion of said rotatable assembly while the full color image is being formed, said stopping position being on a downstream side from said image forming position with respect to a direction of movement of said image forming units, toner being driven from an opening in each of said image forming units to said spilt toner reservoir by gravity, toner which is detached from said developing roller at the image forming position being temporarily stored in said image forming units and being dropped from said opening to said spilt toner reservoir during the rotational movement of said image forming units, and wherein a side wall of said spilt toner reservoir is configured to provide a narrow gap between an edge of said side wall and the outer periphery of said rotatable assembly to prevent scattering of dropped toner due to air flow caused by the rotation of said rotatable assembly in order to receive dropped toner on said receiving portion, said edge being positioned opposite from a receiving portion of said spilt toner reservoir.

12. The color electrographic apparatus of claim 11, wherein each of said image forming units is configured to be capable of moving between an image forming position for forming toner images on said photoconductor and a stopping position, where said opening is disposed to direct toner downward from about the lowermost position of said rotatable assembly, said stopping position being on a downstream side from said image forming position with respect to a direction of movement of said image forming units, and said spilt toner reservoir comprises a receiving portion for receiving dropped toner from an opening in each of said image forming units and a side wall formed on the circumference of said receiving portion, said spilt toner reservoir being located generally opposite to the lowermost portion of said rotatable assembly of said image forming units, said spilt toner reservoir being configured so that a distance between the lowermost portion of the outer periphery of said rotatable assembly and the receiving portion is less than a length of said side wall as measured generally perpendicularly from said receiving portion, the distance between the receiving portion of the spilt toner reservoir and the lowermost portion of the outer periphery being greater than the height of said toner maintained in said spilt toner reservoir.

13. The color electrographic apparatus of claim 11, wherein each of said image forming units is configured to be capable of moving between an image forming position for forming toner images on said photoconductor and a stopping position, where said opening is disposed to direct toner downward from about the lowermost portion of said rotatable assembly, said stopping position being on a downstream side from said image forming position with respect to a direction of movement of said image forming units, and said spilt toner reservoir being positioned generally opposite to the lowermost portion of said rotatable assembly, the spilt toner reservoir being positioned so that said toner received therein does not contact said lowermost portion of the outer periphery of said rotatable assembly.

14. The color electrographic apparatus in accordance with claim 11, wherein said spilt toner reservoir comprises a receiving portion, for receiving dropped toner from an opening in each of said image forming units, and a side wall disposed in vicinity of the outer periphery of said rotatable assembly, a distance between the circumference of said rotatable assembly and said receiving portion being less than the length of said side wall as measured generally perpendicularly to the receiving portion, and an opening of each image forming unit being configured to drop toner into the spilt toner reservoir, while each image forming unit occupies the lowermost portion of the rotatable assembly, and said opening being positioned said distance from the receiving portion of the spilt toner reservoir.

15. A color electrophotographic apparatus comprising:

three or more image forming units for different colors, each of said three or more image forming units having a developing unit, and at least one of said image forming units provided with a central angle around a central axis different from that of the other image forming units, a rotatable assembly of image forming units having said three or more image forming units arranged radially, a photoconductor for having toner images formed thereon, an image superimposing member for forming a full color image by accepting respective toner images formed on said photoconductor, a laser exposure device for irradiating laser signals in accordance with the toner image to be printed, and a spilt toner reservoir having two opposing side walls, the spilt toner reservoir being located at a lowermost position with respect to the image forming units and for receiving dropped toner from an opening in each of said image forming units while said full color image is being formed, each of said image forming units being positioned with said opening facing the spilt toner reservoir when a substantial amount of dropped toner is transferred to the spilt toner reservoir, wherein each of the two opposing side walls extends toward said rotatable assembly to form a narrow gap between an edge, positioned opposite from a receiving portion of the spilt toner reservoir, of each of the two opposing side walls and an outer periphery of said rotatable assembly of image forming units for preventing scattering of dropped toner due to air flow caused by rotation of said rotatable assembly in order to retain dropped toner in said spilt toner reservoir.

16. The apparatus of claim 15, wherein the narrow gap between each of the two opposing side walls and the outer periphery of the rotatable assembly is two millimeters or less.

* * * * *